US006471588B2

(12) United States Patent
Sakamoto

(10) Patent No.: US 6,471,588 B2
(45) Date of Patent: Oct. 29, 2002

(54) GAME MACHINE AND METHOD THAT ADJUSTS STOP INSTRUCTIONS OF REELS WITH RANDOM NUMBERS

(75) Inventor: Yoshikazu Sakamoto, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/899,061

(22) Filed: Jul. 6, 2001

(65) Prior Publication Data

US 2001/0041611 A1 Nov. 15, 2001

Related U.S. Application Data

(62) Division of application No. 09/438,782, filed on Nov. 12, 1999, now Pat. No. 6,315,663.

(30) Foreign Application Priority Data

Nov. 18, 1998 (JP) ..... 10-327636

(51) Int. Cl.[7] ..... A63F 9/24
(52) U.S. Cl. ..... 463/20; 273/143 R
(58) Field of Search ..... 463/20; 273/143 R

(56) References Cited

U.S. PATENT DOCUMENTS 4,184,683 A * 1/1980 Hooker ..... 273/143 R
4,200,291 A * 4/1980 Hooker ..... 273/143 R
4,241,920 A * 12/1980 Hooker ..... 273/143 R
4,618,150 A * 10/1986 Kimura ..... 273/143 R
4,695,053 A * 9/1987 Vazquez et al. ..... 273/143 R
4,773,647 A * 9/1988 Okada et al. ..... 273/143 R
4,826,169 A * 5/1989 Bessho et al. ..... 273/143 R
4,889,339 A * 12/1989 Okada ..... 273/143 R
5,251,898 A * 10/1993 Dickenson et al. ..... 273/143 R
5,769,716 A * 6/1998 Saffari et al. ..... 463/20
6,089,977 A * 7/2000 Bennett ..... 463/20

FOREIGN PATENT DOCUMENTS

GB 2086631 * 5/1982 ..... 273/143 R
GB 2092797 * 8/1982 ..... 273/143 R
GB 2106292 * 4/1983 ..... 273/143 R

* cited by examiner

*Primary Examiner*—Michael O'Neill
(74) *Attorney, Agent, or Firm*—Richard L. Aitken; Venable

(57) ABSTRACT

A game machine comprises a plurality of cylindrical reels each provided with various kinds of symbols on its outer surface. The reels are axially aligned and independently rotatable about an axis in first and second directions. Part of symbols of the respective reels are displayed on a window having a predetermined winning line crossing over the symbol of the respective reels to define the symbols on the winning line as a symbol combination The reels start rotating in the first direction in response to an operation of a start lever. The reels independently stop rotating in response to respective operations of stop buttons to bring the symbol of the corresponding reel to a standstill on the winning line to obtain the symbol combination after all reels are stopped rotating. The symbols are shifted in the first and second directions within a predetermined waiting time to change the symbol combination.

33 Claims, 21 Drawing Sheets

FIG. 13

A1

| REQUEST FOR WINNING | FLAG |
|---|---|
| FAILURE | 0 |
| BULLET | 0 |
| BELL | 1 |
| REPLAY | 0 |
| RB | 0 |
| BB | 0 |

REEL FORWARD ROTATION
ON
OFF

REEL BACKWARD ROTATION
ON
OFF

START INSTRUCTION SIGNAL
ON
OFF

STOP INSTRUCTION SIGNAL
ON
OFF
ROTATING
T1
T2
T3
T1 : CONTROLLING TIME
T2 : OVER- RUN AND STOP OPERATING TIME
T3 : REEL BACKWARD ROTATING TIME

FIG. 21

R REGISTER VALUE (0 - 127) LIST

R1

| FLAG | NO SHIFT | ONE SHIFT | TWO SHIFTS |
|---|---|---|---|
| FAILURE | 0~124 | 125~127 | |
| BULLET | 0~90 | 90~125 | 126~127 |
| BELL | 0~50 | 51~120 | 121~127 |
| REPLAY | 0~100 | 100~125 | 126~127 |
| RB | 0~30 | 31~80 | 81~127 |
| BB | 0~10 | 11~40 | 41~127 |

GAME MACHINE AND METHOD THAT ADJUSTS STOP INSTRUCTIONS OF REELS WITH RANDOM NUMBERS

CROSS REFERENCE TO RELATED APPLICATION

This is a division of application Ser. No. 09/438,782, filed on Nov. 12, 1999, now U.S. Pat. No. 6,315,663, entitled "Game Machine and Method of Controlling."

BACKGROUND OF THE INVENTION

1. Field of the Invention

The present invention relates to a game machine and a method of controlling the game machine, and more particularly, a game machine, such as a slot machine, having a plurality of various kinds of symbols partially displayed and scrolled within a window and being designed to allow a player to stop the scroll of the symbols to decide the combination of symbols displayed within the window.

2. Description of the Related Art

There has been kept wide popularity of a game machine, such as a slot machine, comprising: a plurality of rotatable cylindrical reels each provided with various kinds of symbols on its outer surface at even intervals and independently rotatable about an axis; and a front panel having a window, through which some symbols of the reels are displayed, and a plurality of prize-winning lines on which the symbols of respective reels are positioned when the reels stop rotating. The game machine further comprises: a start lever for allowing the player to instruct the reels to start rotating and generating a start instruction; and a plurality of stop buttons for allowing the player to instruct the reels, respectively, to stop rotating and generating stop instructions respectively corresponding to the reels.

The reels stop rotating in response to the stop instructions, respectively, thereby resulting in the fact that the symbols of the reels are arranged on the prize-winning lines. The game machine is generally operated to evaluate the combinations of these symbols of the reels arranged on the prize-winning lines, and to then pay out a predetermined number of tokens as a prize if the combination of the symbols is coincident with any one of a plurality of predetermined winning combinations of the symbols.

Recently, the game machine of this type particularly called "pachi-slot" can be controlled by a microcomputer to display and scroll the symbols and to produce various visual and audio outputs, thereby making the game machine more attractive to the player.

More specifically, the game machine comprises controlling means, as representatively embodied by the microcomputer, for operating the reels in response to the player's instruction. The controlling means is operated to allow the rotating reels to stop rotating in response to the stop instructions, respectively, after a predetermined time, e.g., 190 msec determined by the existing Japanese law, has been passed since the stop instructions are respectively generated. The controlling means is further operated to previously decide a plan of the result of the game, to estimate the stop position of the last one of the reels to judge whether the combination of the symbols arranged on the winning line makes the result of the game coincident with the previously decided plan or not. The controlling means is, if necessary, operated to shift the position of the reel within the predetermined time to change the combination of the symbols in order to make the game result accord to the decided plan.

In the above conventional game machine, the reels can rotate in an only one-way direction. When the player pushes the stop button to issue the stop instruction, the corresponding reel cannot stop rotating in a moment, but decelerates and keeps it rotating to make the symbols shifted in the one-way direction by a predetermined number of symbols until the reel completely stops rotating. The number of shifting symbols is restricted within a predetermined number, e.g., 5 pieces of symbols. Commonly the player learns the arrangement of symbols on each reel by heart. After stopping the reels excepting the last one of the reels, the player watches the rotating symbols carefully and waits for a chance of winning a desired prize, as taking into account the degree of the deceleration of the reel and the number of shifting symbols. This means that it is necessary for the player to master a high technique for watching the timing of stopping the rotation of the reel and pushing the stop button at this timing in order to obtain a desired combination of symbols thereby winning a desired prize. This makes the game machine more attractive to the player.

However, in the conventional game machine as described above, once the player missed bringing the desired symbol to a standstill on the winning line, the player loses the chance of winning the prize if the rotation of the reel has been decelerated to a low speed inadequate to make the symbol come full circle, because the one-way rotation of the reels makes it impossible to correct the standstill symbol after the desired symbol passed over the prize-winning lines. The player can thus judge that there is no chance of winning the prize, and then fails to keep up interest in the game until all of reels are stopped to bring the symbols to a standstill on the prize-winning line.

SUMMARY OF THE INVENTION

It is an object of the present invention to provide a game machine in which the player can maintain a high expectation of winning until the symbols of all of reels are completely positioned on the effective prize-winning lines. The game machine can greatly excite the player just before the game result is determined.

It is another object of the present invention to provide a method of controlling a game machine in which the player can maintain a high expectation of winning until the symbols of all of reels are completely positioned on the effective prize-winning lines. The game machine can greatly excite the player just before the game result is determined.

In accordance with a first aspect of the present invention, there is provided a game machine for allowing a player to play a game comprising: displaying means capable of displaying a plurality of predetermined symbol arrangements each having various kinds of symbols arranged in a predetermined order; scrolling means for allowing the displaying means to display part of the symbols of the respective symbol arrangements on a window having a predetermined winning line crossing over the symbol of the respective symbol arrangements to define the symbols positioned on the winning line as a symbol combination and to scroll the symbols of the symbol arrangements within the window in two different predetermined scroll directions including first and second scroll directions; scroll starting means for allowing the scrolling means to start to scroll the symbols of the symbol arrangements within the window in the first scroll direction in response to a predetermined start instruction; receiving means for receiving a plurality of stop instructions corresponding to the plurality of symbol arrangements; scroll stopping means for allowing the scrolling means to independently stop scrolling the symbols of the symbol arrangements in response to the plurality of stop instructions, respectively, received by the receiving means to bring the symbol of the corresponding symbol arrangements to a standstill on the winning line to obtain the symbol combination after all of the symbols are stopped scrolling; shifting means for allowing the displaying means to shift the symbols of the symbol arrangements in the first and second scroll directions within a predetermined waiting time after the stop instructions, respectively, are received by the receiving means to change the symbol combination; and evaluating means for evaluating the symbol combination on the basis of a predetermined winning combination for winning.

In the above game machine, the symbols of each of the symbol arrangements may be aligned with a line substantially parallel with the first scroll direction, and the first scroll direction is opposite to the second scroll direction. Furthermore, the displaying means may include a plurality of rotatable cylindrical reels each provided with the various kinds of symbols arranged on its outer surface at predetermined intervals. The reels may be axially aligned and independently rotatable about an axis in the first and second directions.

In the above game machine, the shifting means may be operated to judge whether the symbol of each of the symbol arrangements positioned on the winning line is shifted or not on the basis of a predetermined game condition. Moreover, the shifting means may be operated to determine the number of shifting symbols of each of the symbol arrangements for shifting the symbols in the second scroll direction on the basis of the predetermined game condition. Furthermore, the shifting means may be operated to determine the number of shifting symbols of each of the symbol arrangements for shifting the symbols in the first scroll direction on the basis of the number of symbols of each symbol arrangements for shifting the symbols in the second scroll direction.

The above game machine may further comprise inputting means for allowing the player to input the stop instructions to the game machine.

The above game machine may further comprise deciding means for previously deciding a plan of the result of the game. The shifting means may be operated to judge whether there is a chance to obtain the result of the game according to the plan decided by the deciding means within the waiting time or not, and to shift the symbol in the first and second scroll directions so that the result of the game accords to the plan decided by the deciding means. Moreover, the plan decided by the deciding means may include a plan of the symbol combination for evaluating. The shifting means may be operated to judge whether the symbols of the symbol arrangement can be brought to a standstill on the winning line within the waiting time to obtain the symbol combination according to the plan decided by the deciding means or not, and to shift the symbol in the first and second scroll directions to change the symbol combination in accordance with the plan decided by the deciding means when the judgment is made that the symbols of the symbol arrangement can be brought to a standstill on the winning line within the waiting time to obtain the symbol combination according to the plan decided by the deciding means.

In accordance with a second aspect of the present invention, there is provided a method of controlling a game machine for allowing a player to play a game comprising the steps of:

(a) forming a plurality of predetermined symbol arrangements each having various kinds of symbols arranged in a predetermined order;

(b) displaying part of the symbols of the respective symbol arrangements on a window having a predetermined winning line crossing over the symbol of the respective symbol arrangements to define the symbols positioned on the winning line as a symbol combination;

(c) scrolling the symbols of the symbol arrangements within the window in a first predetermined scroll direction in response to a predetermined start instruction;

(d) receiving a plurality of stop instructions corresponding to the plurality of symbol arrangements;

(e) stopping scrolling the symbols of the symbol arrangements in response to the plurality of the stop instructions, respectively, received in the step (d) to bring the symbols of the corresponding symbol arrangements to a standstill on the winning line;

(f) obtaining the symbol combination after all of the symbol arrangements are stopped scrolling in the step (e);

(g) shifting the symbols of the symbol arrangements in the first scroll direction within a predetermined waiting time after the step (d);

(h) shifting the symbols of the symbol arrangements in a second predetermined scroll direction different from the first scroll direction within the waiting time;

(i) performing the steps (g) and (h) to change the symbol combination; and (j) evaluating the symbol combination on the basis of a predetermined winning combination for winning.

In the above method, the symbols of each of the symbol arrangements may be aligned with a line substantially parallel with the first scroll direction, and the first scroll direction is opposite to the second scroll direction.

In the above method, the step (i) may have the step of judging whether the symbol of each of the symbol arrangements positioned on the winning line is shifted or not on the basis of a predetermined game condition. Moreover, the step (h) may have the step of determining the number of shifting symbols of each of the symbol arrangements for shifting the symbols in the second scroll direction on the basis of the predetermined game condition. The step (g) may have the step of determining the number of shifting symbols of each of the symbol arrangements for shifting the symbols in the first scroll direction on the basis of the number of symbols of each symbol arrangements for shifting the symbols in the second scroll direction in the step (h).

The above method may further comprise the step of allowing the player to input the stop instructions to the game machine.

The above method may further comprise the steps of:

(k) deciding a plan of the result of the game;

(l) judging whether there is a chance to obtain the result of the game according to the plan decided in the step (k) within the waiting time or not; and (m) performing the step (i) so that the result of the game accords to the plan decided in the step (k).

In the above method, the plan decided in the step (k) may include a plan of the symbol combination for evaluating. The step (l) may have the step of judging whether the symbols of the symbol arrangement can be brought to a standstill on the winning line within the waiting time to obtain the symbol combination according to the plan decided in the step (k) or not. The step (i) may have the step of performing the step (h) to change the symbol combination in accordance with the plan decided in the step (k) when the judgment is made in the step (l) that the symbols of the symbol arrangement can be brought to a standstill on the winning line within the waiting time to obtain the symbol combination according to the plan decided in the step (k).

In accordance with a third aspect of the present invention, there is provided a game machine for allowing a player to play a game comprising: displaying means capable of displaying a predetermined symbol arrangement having various kinds of symbols arranged in a predetermined order; scrolling means for allowing the displaying means to display part of the symbols of the symbol arrangement on a window having a predetermined winning point and to scroll the symbols within the window in a first predetermined scroll direction; scroll starting means for allowing the scrolling means to start to scroll the symbols within the window in the first scroll direction in response to a predetermined start instruction; receiving means for receiving a predetermined stop instruction; scroll stopping means for allowing the scrolling means to stop scrolling the symbols in response to the stop instruction received by the receiving means to bring one of the symbols to a standstill at the winning point; shifting means for allowing the displaying means to shift the symbols in the first scroll direction and a second predetermined scroll direction different from the first scroll direction within a predetermined waiting time after the stop instruction is received by the receiving means to change the kind of the symbol positioned at the winning point; and evaluating means for evaluating the kind of the symbol positioned at the winning point on the basis of a predetermined kind of symbol for winning.

In the above game machine, the symbols may be aligned with a line substantially parallel with the first scroll direction, and the first scroll direction is opposite to the second scroll direction.

In the above game machine, the shifting means may be operated to judge whether the symbol positioned at the winning point is shifted or not on the basis of a predetermined game condition. Moreover, the shifting means may be operated to determine the number of shifting symbols for shifting the symbols in the second scroll direction on the basis of the predetermined game condition. Furthermore, the shifting means may be operated to determine the number of shifting symbols for shifting the symbols in the first scroll direction on the basis of the number of shifting symbols for shifting the symbols in the second scroll direction.

The above game machine may further comprise inputting means for allowing the player to input the stop instruction to the game machine.

The above game machine may further comprise deciding means for previously deciding a plan of the result of the game. The shifting means may be operated to judge whether there is a chance to obtain the result of the game according to the plan decided by the deciding means within the waiting time or not, and to shift the symbol in the first and second scroll directions so that the result of the game accords to the plan decided by the deciding means. In the above game machine, the plan decided by the deciding means may include a plan of the kind of symbol for evaluating. The shifting means may be operated to judge whether the symbol of the symbol arrangement can be brought to a standstill at the winning point within the waiting time to obtain the symbol according to the plan decided by the deciding means or not, and to shift the symbol in the second scroll direction to change the kind of the symbol in accordance with the plan decided by the deciding means when the judgment is made that the symbol of the symbol arrangement can be brought to a standstill at the winning point within the waiting time to obtain the symbol according to the plan decided by the deciding means.

In accordance with a fourth aspect of the present invention, there is provided a method of controlling a game machine for allowing a player to play a game, comprising the steps of:

(a) forming a predetermined symbol arrangement having various kinds of symbols arranged in a predetermined order;

(b) displaying part of the symbols of the symbol arrangement on a window;

(c) scrolling the symbols within the window in a first predetermined scroll direction in response to a predetermined start instruction;

(d) receiving a predetermined stop instruction;

(e) stopping the scroll of the symbols in response to the stop instruction received in the step (d) to bring one of the symbols to a standstill at a predetermined winning point provided with the window;

(f) shifting the symbol in the first scroll direction within a predetermined waiting time after the step (d);

(g) shifting the symbol in a second predetermined scroll direction different from the first scroll direction;

(i) performing the steps (f) and (g) to change the kind of the symbol positioned at the winning point; and (i) evaluating the kind of the symbol positioned at the winning point on the basis of a predetermined kind of symbol for winning.

In the above method, the symbols may be aligned with a line substantially parallel with the first scroll direction, and the second scroll direction is opposite to the first scroll direction.

In the above method, the step (h) may have the step of judging whether the symbol positioned at the winning point is shifted or not on the basis of a predetermined game condition. The step (g) may have the step of determining the number of shifting symbols for shifting the symbols in the second scroll direction on the basis of the predetermined game condition. Furthermore, the step (f) may have the step of determining the number of shifting symbols for shifting the symbols in the first scroll direction on the basis of the number of shifting symbols for shifting the symbols in the second scroll direction in the step (g).

The above method may further comprise the step of allowing the player to input the stop instruction to the game machine.

The above method may further comprise the steps of:

(j) deciding a plan of the result of the game; and (k) judging whether there is a chance to obtain the result of the game according to the plan decided in the step (j) within the waiting time or not; and (l) performing the step (i) so that the result of the game accords to the plan decided in the step (j).

In the above method, the plan decided in the step (j) may include a plan of the kind of symbol for evaluating. The step (k) may have the step of judging whether the symbol of the symbol arrangement can be brought to a standstill at the winning point within the waiting time to obtain the symbol according to the plan decided in the step (j) or not. Moreover, the step (h) may have the step of performing the step (g) to change the kind of the symbol in accordance with the plan decided in the step (j) when the judgment is made in the step (k) that the symbol of the symbol arrangement can be brought to a standstill at the winning point within the waiting time to obtain the symbol according to the plan decided in the step (j).

BRIEF DESCRIPTION OF THE DRAWINGS

The feature and advantages of the present invention will become more apparent from the following detailed description when considered in connection with the accompanying drawings, wherein:

FIG. 13 is a schematic diagram of the winning request area stored in the ROM of the game machine shown in FIG. 5;

FIG. 18(*b*) is a timing chart of the backward rotation of the reel of the game machine shown in FIG. 1;

FIG. 18(*c*) is a timing chart of the start instruction signal of the game machine shown in FIG. 1;

FIG. 18 (*d*) is a timing chart of the stop instruction signal of the game machine shown in FIG. 1;

FIG. 21 is a diagram showing the stop condition table for searching the number of additional shifting symbols on the basis of the relationship between the flags and the random number in the third embodiment.

DESCRIPTION OF THE PREFERRED EMBODIMENTS

Referring now to FIGS. 1 to 18 of the drawings, there is shown a first preferred embodiment of the game machine according to the present invention.

Figure 1:
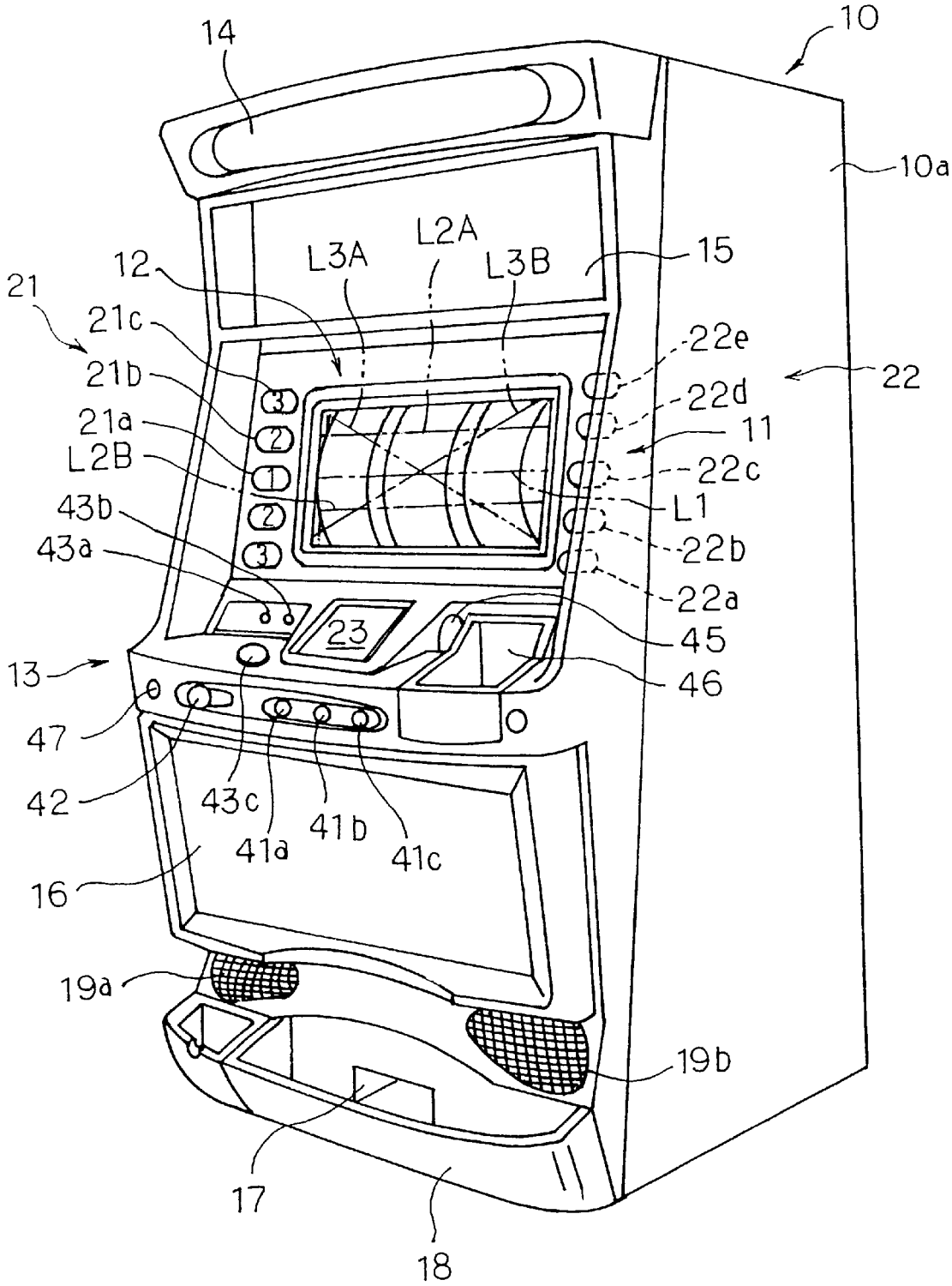
FIG. 1 is a perspective view of a first embodiment of the game machine according to the present invention.

FIG. 1 is a perspective view of the first embodiment of the game machine exemplified by a slot machine 10. As shown in FIG. 1, the slot machine 10 comprises a housing 10*a* including a front panel 11. The front panel 11 is provided with a reel unit panel 12, an operation unit 13, a game condition indicating panel 14, a dividend rate display panel 15, a bottom panel 16, a medal payout opening 17, a saucer 18, and a pair of speakers 19*a* and 19*b*.

Figure 2:
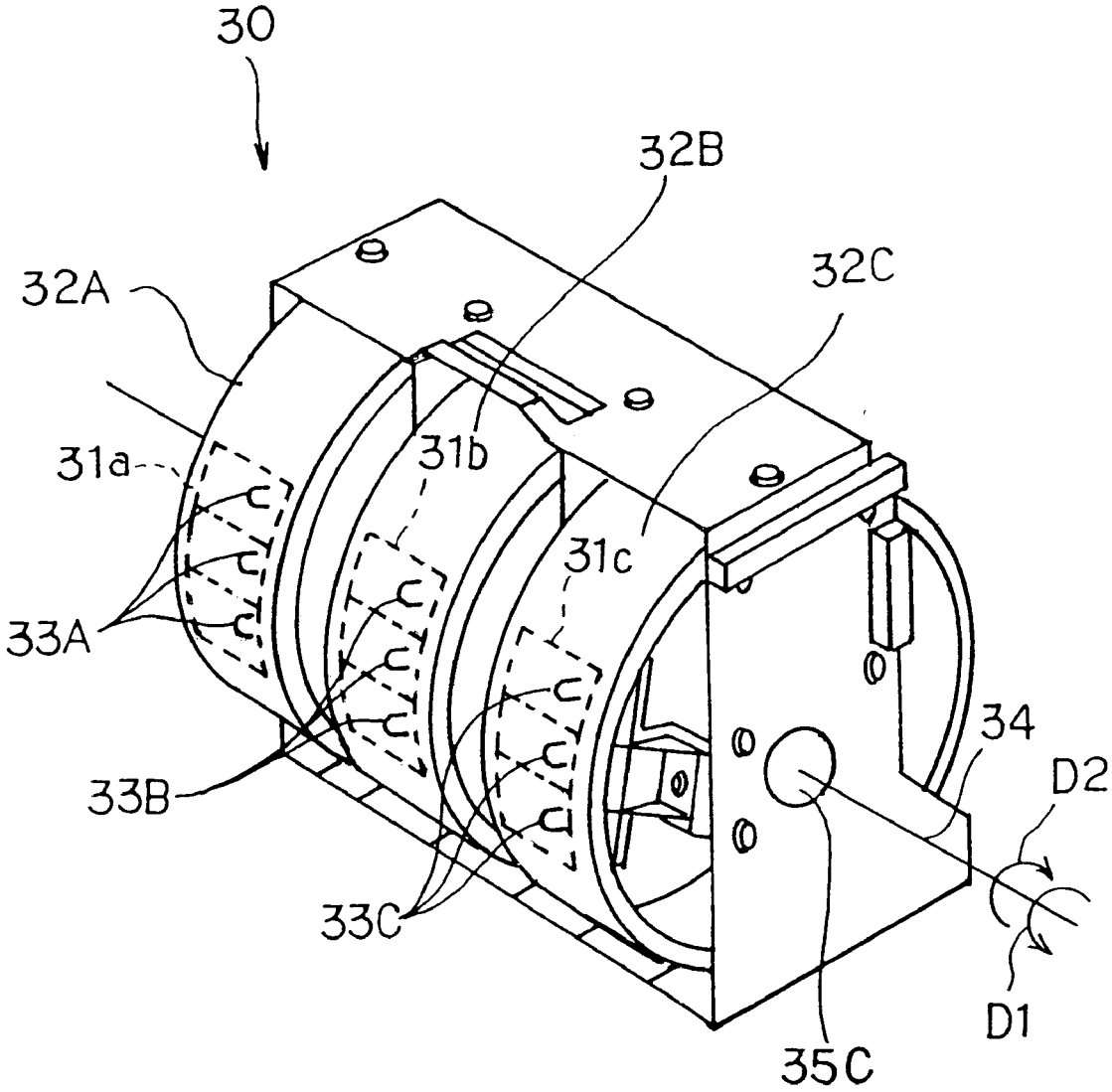
FIG. 2 is a perspective view of the reel unit provided for the game machine shown in FIG. 1.

The slot machine 10 has a reel unit 30 housed in the housing 10*a* and having a plurality of rotatable cylindrical reels 32A, 32B and 32C as shown in FIG. 2. The plurality of the reels 32A, 32B and 32C are independently selectively rotated in first and second directions D1 and D2 about an axis 34 by a plurality of stepping motors 35A, 35B (not shown) and 35C, respectively. The plurality of stepping motors 35A, 35B and 35C have a plurality of shafts (not shown) axially mechanically connected to the reels 32A, 32B and 32C, respectively. The stepping motors 35A, 35B and 35C are designed to independently drive the reels 32A, 32B and 32C, respectively, to rotate at the variable speed per a predetermined minimum rotary angle, e.g., a predetermined step angle.

Figure 3:
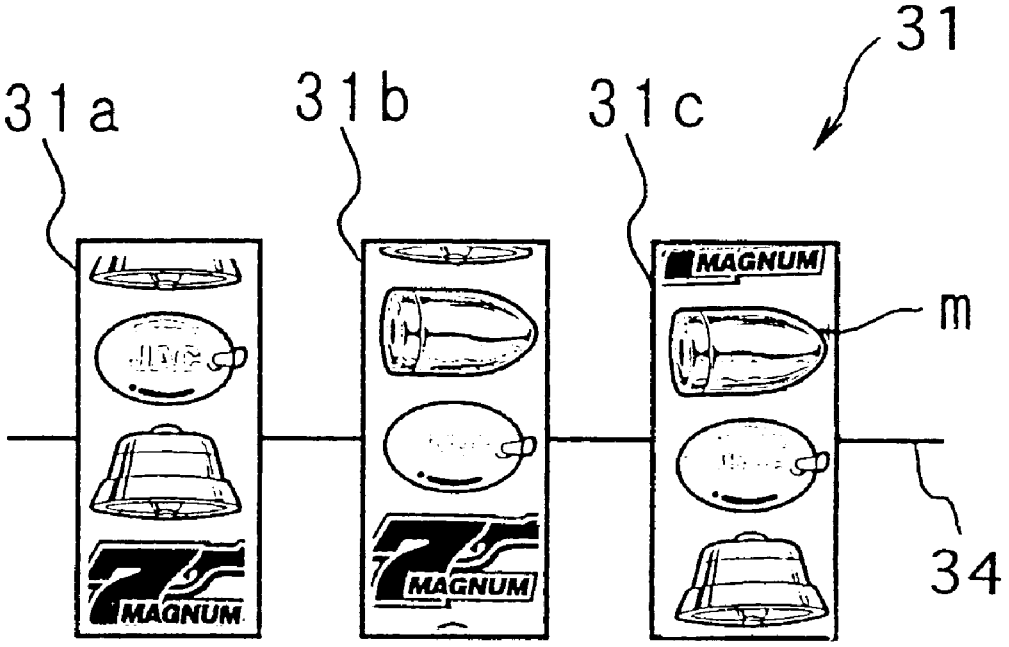
FIG. 3 is a front view of the symbol displaying area of the reel unit panel of the game machine shown in FIG. 1.

Each of the reels 32A, 32B and 32C has various kinds of symbols serially arranged in a predetermined order on its surface at even intervals. In this embodiment, each reel has twenty-one pieces of symbols consisting of seven different types, for instance, "bell", "bullet", "cherry", "bar", "7" and so on. Referring to FIG. 3, there is shown a front view of the reel unit panel 12 in which the plurality of reels 32A, 32B and 32C are axially arranged behind the reel unit panel 12 to display their several symbols, represented by the reference character "m", through a plurality of windows 31*a*, 31*b* and 31*c*, respectively. In this embodiment, three symbols are displayed in each windows 31*a*, 31*b* and 31*c*.

In FIG. 2, the reel unit 30 further has a plurality of lamp units 33A, 33B and 33C provided for the reels 32A, 32B and 32C, respectively. Each of the lamp units 33A, 33B and 33C has a plurality of lamps for lighting up a predetermined number of the symbols from behind the symbols, respectively, in order to show the predetermined number of the symbols within each of the windows 31*a*, 31*b* and 3l*c*. These windows 31*a*, 31*b* and 31*c* are integrally formed into a symbol displaying area 31 in the reel unit panel 12 as shown in FIG. 3. In this embodiment, each of the lamp units 33A, 33B and 33C has three lamps, so that three pieces of symbols can be displayed on the each of the windows 31*a*, 31*b* and 31*c*. The reel unit panel 12, the reels 32A, 32B and 32C, and the lamp units 33A, 33B and 33C thus constructed can integrally serve as displaying means according to the present invention. The displaying means is controlled by controlling means, which will be described later, to display the symbols movable in predetermined directions within the symbol displaying area 31.

In another embodiment, the displaying means may be constructed by a digital displaying unit, not shown, such as a Liquid Crystal Display unit (LCD), a Cathode Ray Tube display unit (CRT), a plasma display unit and so forth. The digital displaying unit is controlled by a predetermined control unit to produce a digital graphics. The digital displaying unit is operable to display a plurality of symbol arrangements and to scroll part of the symbols of the respective symbol arrangements in predetermined directions in order to simulate the motions of the symbols in every direction.

The graphical symbol may be drawn by a dot pattern on the screen of the digital displaying unit and reproduced to shift the dot pattern in a predetermined direction to the forward position by a predetermined number of dots in response to every interrupt signals. Thus, the graphical symbol can be moved in various different directions crossed at various different angles.

Figure 4:
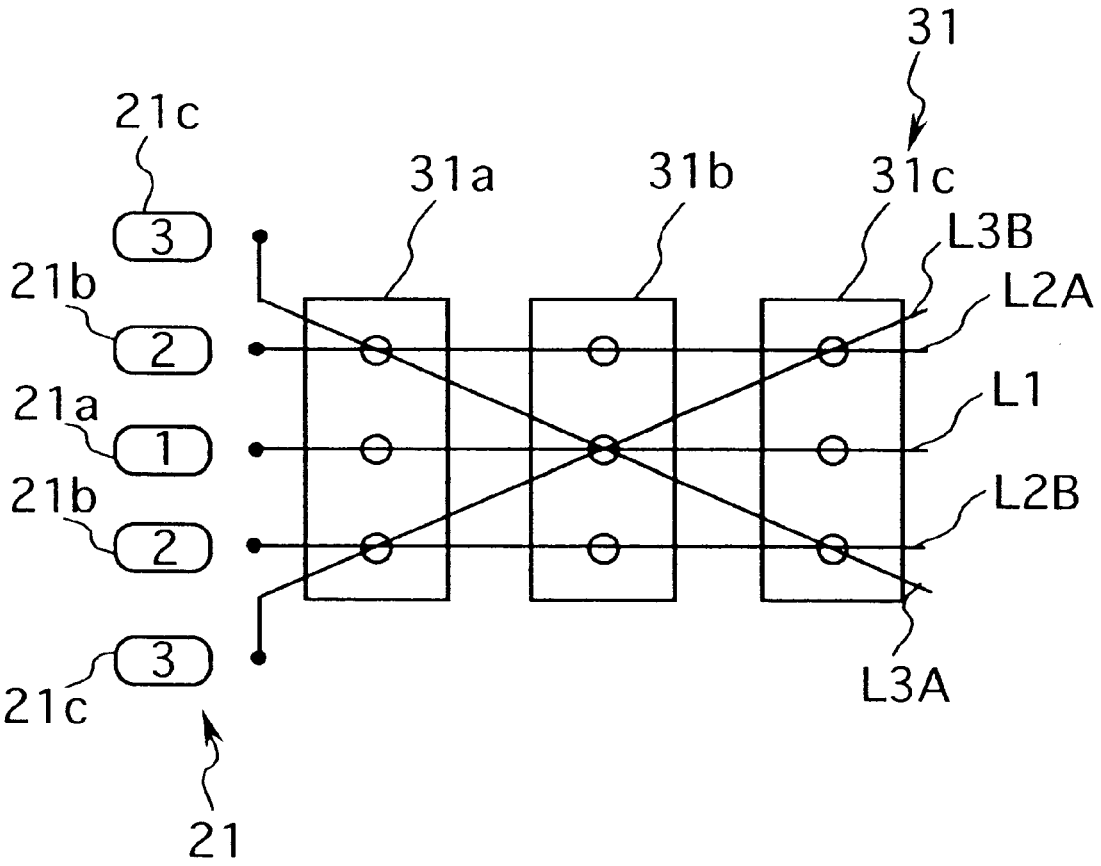
FIG. 4 is a schematic front view of the reel unit panel of the game machine shown in FIG. 1.

As shown in FIG. 4, the symbol displaying area 31 has a plurality of prize-winning lines including: a center winning line L1 horizontally extending over the center of the windows 31*a*, 31*b* and 31*c*; a pair of upper and lower winning lines L2A and L2B disposed on upper and lower sides of the center winning line L1 and extending in parallel relationship with the center winning line L1; and a pair of cross winning lines L3A and L3B crossed at oblique angles other and traversing the prize-winning lines L1, L2A and L2B. Each of the prize-winning lines is thus designed to cross one symbol of each of the reels 32A, 32B and 32C within the symbol displaying area 31, thereby having three symbols positioned thereon in total. The combination of three symbols positioned on each of the prize-winning lines is referred to as "three-symbols combination" hereinlater. In another embodiment, the winning line may be replaced with a predetermined winning point.

The slot machine 10 comprises an investing medal number indicating unit 21 or indicating the number of investing medals for the present game by blinking. The investing medal number indicating unit 21 has a plurality of lamps arranged on one side of the symbol displaying area 31 of the reel panel unit 12. The investing medal number indicating unit 21 includes: a lamp 21*a* disposed on one end side of the center winning line L1 for indicating that one medal is invested in betting for the present game in which the slot machine 10 is operated to evaluate a single three-symbols combination positioned on the center winning line L1; a pair of lamps 21*b* disposed on one end sides of the upper and lower winning lines L2A and L2B, respectively, for indicating that two medals are invested in betting for the present game in which the slot machine 10 is operated to evaluate two three-symbols combinations positioned on the upper and lower winning lines L2A and L2B, respectively, in addition to one three-symbols combination positioned on the center winning line L1; and a pair of lamps 21*c* disposed on one end sides of the cross winning lines L3A and L3B, respectively, for indicating that three medals are invested in betting for the present game in which the slot machine is operated to evaluate five three-symbols combinations positioned on five prize-winning lines L1, L2A, L2B, L3A and L3B, respectively.

As shown in FIG. 1, the slot machine 10 further comprises a game condition indicating unit 22 has a plurality of game condition indicators arranged on the other side of the symbol displaying area 31 of the reel panel unit 12 and indicating various game conditions in various game situations. The game condition indicators includes: a medal insertion indicator 22*a* for indicating that the slot machine 10 is operating under the condition to enable the slot machine 10 to receive the medals therein; a game start indicator 22*b* for indicating that the slot machine 10 is operating under the condition to enable the slot machine 10 to start rotating the reels; a prize winning indicator 22*c* for indicating that a prize is won in the present game; a waiting indicator 22*d* for indicating that the slot machine 10 is operating under the unready condition; and a free game indicator 22*e* for indicating that the slot machine 10 is operating under the condition to play a free game.

The slot machine 10 further comprises a display unit 23, such as a Liquid Crystal Display unit (LCD), disposed under the reel panel unit 12 for displaying various information on the game, e.g., the number of credit medals, an expectation of the prize-winning, the number of prize-winning games, the number of pay-out medals, and so on.

The operation unit 13 comprises: a plurality of stop buttons 41*a*, 41*b* and 41*c* arranged under the LCD unit 23 for respectively operating the reels 32A, 32B and 32C to stop rotating; a start lever 42 arranged on the left side of the stop buttons 41*a*, 41*b*and 41*c*for operating all of the reels 32A, 32B and 32C to simultaneously start rotating; a plurality of medal investing buttons 43*a*, 43*b* and 43*c* arranged on the left side of the LCD unit 23 for allowing the player to respectively select one medal, two medals and three medals for investing in betting for the present game; a medal inlet slot 45 for 5 allowing the player to insert the medals one by one by hand to the slot machine 10 therethrough; and a medal inlet port 46 for allowing the player to insert a lot of medals to a container, not shown, in the slot machine. The container is capable to storing therein a large number of medals in order to automatically invest the medals in betting by extracting some medals therefrom. The operation unit 13 further comprises a credit medal settlement button 47 for allowing the player to request the slot machine 10 to pay the credit medals by extracting from a hopper 81, not shown in detailed.

The game condition indicating panel 14 is disposed on the top of the front panel 11 of the slot machine 10 and has a lamp disposed behind the panel for indicating a plurality of different modes in which the slot machine 10 operates. The game condition indicating panel 14 is operated to blink at a plurality of different predetermined blinking interval patterns corresponding to the different modes, respectively. The plurality of different modes may include a prize-winning play mode, a repeatedly prize-winning play mode, an error mode, a play-out mode, a prize-winning expecting mode, a medal withdrawing mode, and so on.

The dividend rate display panel 15 is positioned under the game condition indicating panel 14 and designed to indicate information on the dividend rate for the game in the slot machine 10. For instance, the information may include a list of a plurality of winning combinations for bringing the game to operate under predetermined special game conditions having a high expectation of winning and a high dividend rate, and a list of the number of medals awarded corresponding to each of predetermined winning combinations.

The bottom panel 16 is disposed on the bottom of the front panel 11 of the slot machine 10 and has a name and a model of the slot machine 10 printed thereon. The medal pay-out opening 17 is formed on the lower portion of the front panel 11 for paying out the medals therethrough. The pay-out medals are then received by the saucer 18.

The slot machine 10 thus constructed can allow the player to play the game through the following steps of: allowing the player to invest one to three medals in betting for the present game to cause the prize-winning lines corresponding to the number of the invested medals to be effective by inserting the medal into the slot machine 10 through the medal inlet slot 45 or by selecting one from the medal investing buttons 43*a*, 43*b* and 43*c*; allowing the player to operate the start lever 42 to simultaneously start rotating the reels 32A, 32B and 32C; allowing the player to operate the stop buttons 41*a*, 41*b* and 41*c* to stop rotating the reels 32A, 32B and 32C to bring the symbols of the reels 32A, 32B and 32C, respectively, to a standstill on the effective winning lines to obtain three-symbols combinations corresponding to the effective winning lines; and evaluating the obtained three-symbols combinations and awarding a prize in accordance with the evaluated result when the three-symbols combinations are worth winning.

Figure 5:
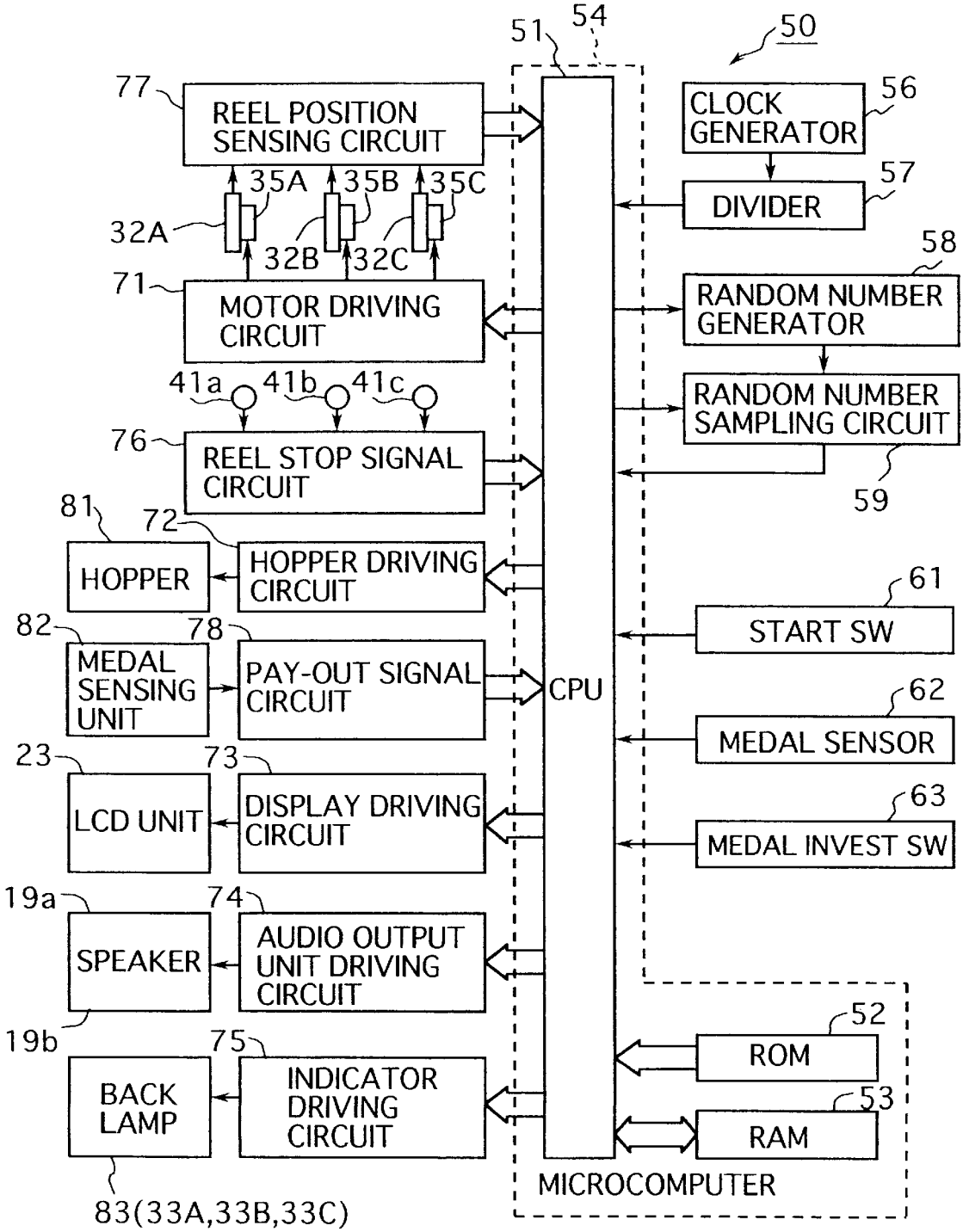
FIG. 5 is a schematic block diagram showing the configuration of the control unit of the game machine shown in FIG. 1.

Referring to FIG. 5 of the drawings, there is shown a control unit 50 for controlling the slot machine 10. As shown in FIG. 5, the control unit 50 comprises a microcomputer 54 equipped with a Central Processing Unit (CPU) 51, and a Read Only Memory (ROM) 52 for storing therein a predetermined program and data for controlling the slot machine 10, and a Random Access Memory (RAM) 53 for temporary storing therein data and serving as a work area. The control unit 50 further comprises a clock generator 56, a divider 57, a random number generator 58, and a random number sampling circuit 59. The clock generator 56 is designed to generate a base clock pulse.

The divider 57 is electrically connected to the clock generator 56 and designed to input the base clock pulse generated by the clock generator 56 to divide the inputted base clock pulse and then to produce an interrupt signal pulse. The divider 57 is also electrically connected to the microcomputer 54. The produced interrupt signal pulse is then transmitted to the microcomputer 54. The random number generator 58 is electrically connected to the microcomputer 54 and designed to generate a random number. The random number sampling circuit 59 is electrically connected to the random number generator 58 and designed to sample one of the random numbers generated by the random number generator 58 in response to a predetermined instruction signal from the microcomputer 54. The sampled random number is within a predetermined limited range.

In another embodiment, the random number generator 58 and the random number sampling circuit 59 may be replaced with a predetermined random number sampling process carried out by the CPU 51 of the control unit 50 by executing a predetermined program.

The control unit 50 further comprises inputting means for inputting, to the microcomputer 54, various instructions issued by an operator and various control signals transmitted from a host computer (not shown) which is linked with the microcomputer 54. The inputting means is equipped with a group of various sensors including a start switch 61, a medal sensor 62 and a medal invest switch 63. The start switch 61 is electrically connected to the start lever 42 and designed to generate a predetermined start instruction signal in response to the signal transferred from the start lever 42 when the operator operates the start lever 42. The start switch 61 is also electrically connected to the microcomputer 54 and designed to then transfer the start instruction to the microcomputer 54. The start lever 42 serves as scroll starting means in cooperation with the start switch 61 to generate the start instruction signal to allow the microcomputer 54 to instruct the reels 32A, 32B and 32C to simultaneously start to rotate.

The medal sensor 62 is electrically connected to the microcomputer 54 and designed to sense the insertion of the medals through the medal inlet slot 45 and to then inform the microcomputer 54 on the insertion of the medals. The medal invest switch 63 is electrically connected to the medal investing buttons 43*a*, 43*b* and 43*c* and designed to detect which of buttons is operated by the player. The medal invest switch 63 is electrically connected to the microcomputer 54 and designed to inform the microcomputer 54 which of medal investing buttons 43*a*, 43*b* and 43*c* is operated by the player.

The control unit 50 further comprises a motor driving circuit 71, a hopper driving circuit 72, a display driving circuit 73, an audio outputting unit driving circuit 74, an indicator driving circuit 75, a reel stop signal circuit 76, a reel position sensing circuit 77, and a pay-out signal circuit 78. The microcomputer 54 is electrically connected to these circuits and is operated to control the operations of these circuits for driving various actuators in the slot machine 10 and detect the conditions of these operations.

The motor driving circuit 71 is electrically connected to the stepping motors 35A, 35B and 35C and designed to generate a plurality of motor driving pulses corresponding to the stepping motors 35A, 35B and 35C to then transmit the motor driving pulses to the stepping motors 35A, 35B and 35C, respectively.

In this embodiment, each of the stepping motors 35A, 35B and 35C is the type of a half step driving motor having a plurality of winding coil groups including, for example, four phases A, B, C and D. The phases A, B, C and D of the winding coil group are sequentially driven on in response to the motor driving pulse transmitted every predetermined step time (e.g., 1.88 msec) in a predetermined cyclic order, for instance, the phases A and D are driven on, the phase A is then driven on, the phases A and B are then driven on, the phase B is then driven on, the phases B and C are then driven on, the phase C is then driven on, the phases C and D are then driven on, and the phase D is then driven on. In this sequence, each of the stepping motors 35A, 35B and 35C can be repeatedly rotated at one step angle every step of driving one of the phases, thereby making it possible to cause the corresponding reel continuously rotate in a predetermined direction, for instance the first direction DI. The reel may be rotated in a reverse direction, e.g., the second direction D2, by sequentially driving the winding coil group in reverse cyclic order, i.e., the phases A and D, the phase D, the phases D and C, the phase C, the phases C and B, the phase B, the phases B and A, and the phase A. The microcomputer 54 is operated to control the motor driving circuit 71 to produce the motor driving pulses in order to rotate the stepping motor 35A, 35B and 35C, respectively. The detailed description of this operation will be made later.

The rotation speed of the reel can be regulated by varying the pulse duration of the motor driving pulse. In case of the reel accelerating process, the motor driving circuit 71 is firstly operated to output the motor driving pulse for a first predetermined pulse duration, e.g., 22.56 msec (=1.88×12). The motor driving circuit 71 is then operated to output the motor driving pulse for a second predetermined pulse duration, e.g., 13.16 msec (=1.88×7). After repeating to output this motor driving pulse predetermined times, the motor driving circuit 71 is operated to repeatedly output the motor driving pulse for a third predetermined pulse duration, e.g., 9.40 msec (=1.88×5) predetermined times. Thereafter, the motor driving pulse is repeatedly outputted for a fourth predetermined pulse duration, e.g., 3.76 msec (1.88×2) predetermined times before each reel is rotated at a constant speed. Consequently, the stepping motor can be driven to rotate at the constant speed, while the motor driving pulse is repeatedly outputted for a fifth predetermined pulse duration, e.g., 1.88 msec.

In case of the reel decelerating process, on the other hand, the pulse duration of the motor driving pulse is gradually increased in order to stop rotating the reel.

The hopper driving circuit 72 is electrically connected to the hopper 81. The hopper driving circuit 72 is designed to generate a hopper driving signal in response to a predetermined pay-out request signal transmitted from the microcomputer 54. The hopper driving signal is then outputted to the hopper 81 so that the medals is paid out from the hopper 81 in response to the pay-out request signal. The display driving circuit 73 is electrically connected to the LCD unit 23 and designed to drive the LCD unit 23 to display the various information on the game, e.g., the number of credit medals, an expectation of prize-winning, the number of prize-winning, the number of pay-out medals, and so on.

The audio outputting unit driving circuit 74 is electrically connected to an audio outputting unit, such as the speakers 19*a* and 19*b*, and designed to drive the speakers 19*a* and 19*b*. The indicator driving circuit 75 is electrically connected to a plurality of back lamps 83, which are provided in the inside of the housing 10*a* of the slot machine 10, for example, the lamps of the lamp units 33A, 33B and 33C, and the lamp of the game condition indicating panel 14. The indicator driving circuit 75 is designed to operate the back lamps 83 to turn on and off or blink at predetermined intervals according to the aforesaid conditions of the game. The reel stop signal circuit 76 is electrically connected to the stop buttons 41*a*, 41*b* and 41*c*. The reel stop signal circuit 76 is designed to generate a plurality of predetermined stop instruction signals for stopping the rotations of the reels 32A, 32B and 32C in response to the operations of stop buttons 41*a*, 41*b* and 41*c*, respectively. The stop instruction signals are then transmitted to the microcomputer 54. The player may selectively operate the stop buttons 41*a*, 41*b* and 41*c* so that the reels 32A, 32B and 32C, respectively, stop rotating to bring the desired symbols to a standstill on a predetermined position, e.g., the effective prize-winning lines. The stop buttons 41*a*, 41*b* and 41*c* serve as scroll stopping means in cooperation with the reel stop signal circuit 76 to allow the microcomputer 54 to generate the stop instruction signals to instruct the reels 32A, 32B and 32C, respectively, to stop rotating.

The reel position sensing circuit 77 is electrically connected to the reels 32A, 32B and 32C and designed to sense the position of each of the reels 32A, 32B and 32C by calculating a rotary angle on the basis of a predetermined standard position. The reel position sensing circuit 77 is further designed to generate a predetermined reset pulse, when each of the reels 32A, 32B and 32C makes one rotation to transmit to the microcomputer 54.

The pay-out signal circuit 78 is electrically connected to a medal sensing unit 82 (not shown in detail) for sensing that the medal is paid out and outputting a medal sensing signal. The pay-out signal circuit 78 is designed to count the number of the pay-out medals in accordance with the medal sensing signal transmitted from the medal sensing unit 82, and then to output a pay-out completion signal to the microcomputer 54 when the counted number of the pay-out medals exceeds a predetermined number.

The microcomputer 54 thus constructed can operate to control the operations of the circuits, actuators and units, e.g., the stepping motors 35A, 35B and 35C and the display unit 23, in accordance with a predetermined control program stored in the ROM 52 in cooperation with data stored in the ROM 52, and various information including an operation information on the player's operation in accordance with the signals transmitted from the inputting means, such as the switches 61 and an operative condition information sensed by the aforesaid sensors. The ROM 52 contains a predetermined expectation of prize winning table, a predetermined symbol design table, and a predetermined winning combination table including a plurality of predetermined winning combinations of symbols for winning a prize.

The predetermined winning combination may include a big bonus combination and a regular bonus combination thereby causing the game to enter a predetermined special game condition. The other combination may be a predetermined combination of three of the same symbols, for example, "bell" symbols or "bullet" symbols, thereby causing the game to award several medals. Furthermore, a replay combination causes the game to enter a free game condition. Accordingly, the microcomputer 54 can detect the positions of the symbols of each of the reels on the basis of the rotary angle relative with respect to the standard position transmitted from the reel position sensing circuit 77.

Each of the reels 32A, 32B and 32C is marked with a plurality of position codes spaced at predetermined rotary angle intervals from the predetermined standard position. The predetermined position codes correspond to the positions of the symbols, respectively, in the each of reels 32A, 32B and 32C. The predetermined symbol design table has a relationship between the position codes and a predetermined symbol codes corresponding to the kinds of the symbols stored in the ROM 52.

The predetermined winning combination table further has the number of medals for awarding a prize and a predetermined prize winning judgment codes corresponding to the winning combinations. This winning combination table is thus used for the stop control of the rotations of the reels 32A, 32B and 32C and the judgment for awarding a winning prize.

Figure 6:
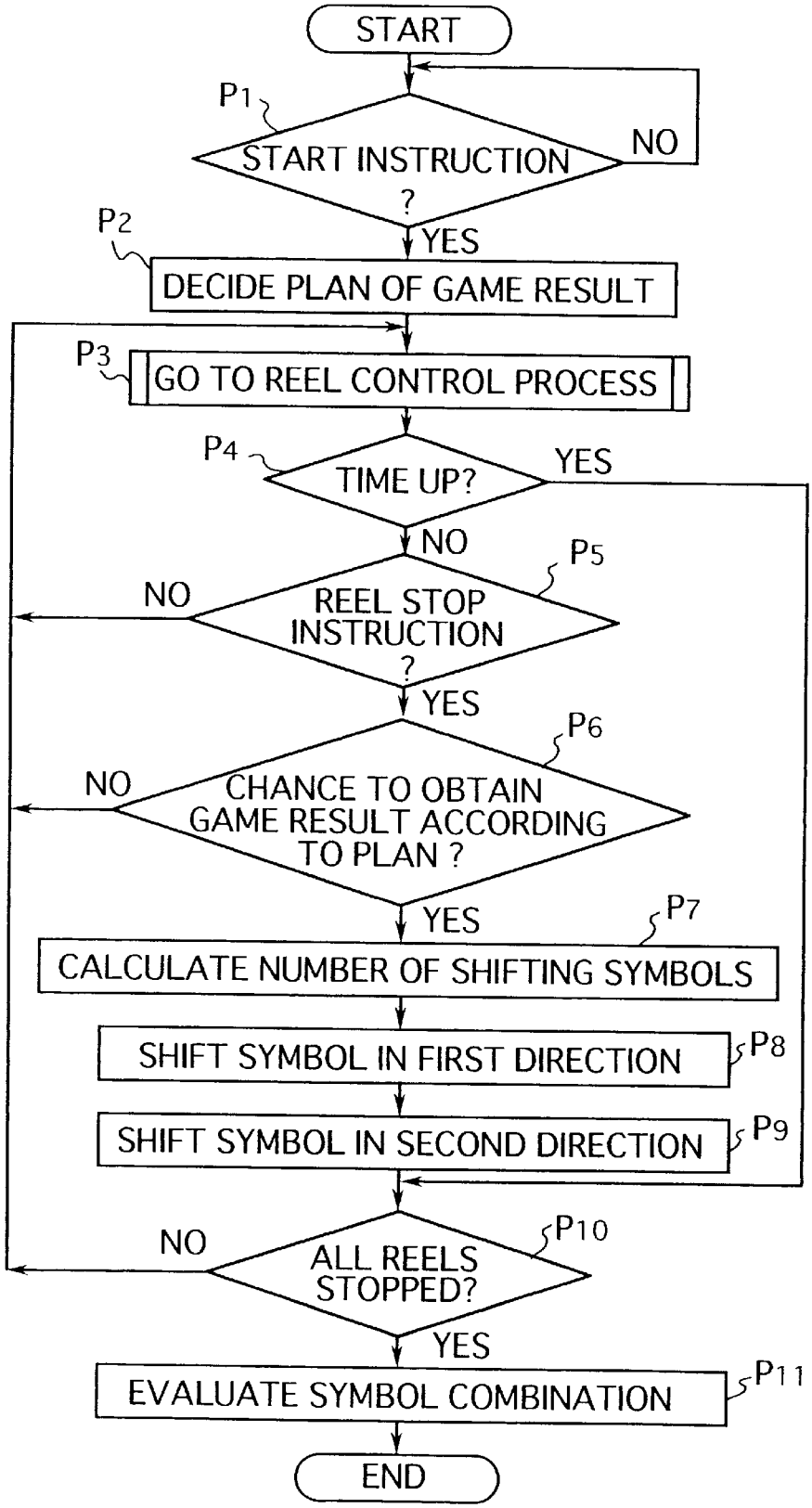
FIG. 6 is a flowchart showing the flow of the process of controlling the game machine shown in FIG. 1.
Figure 7:
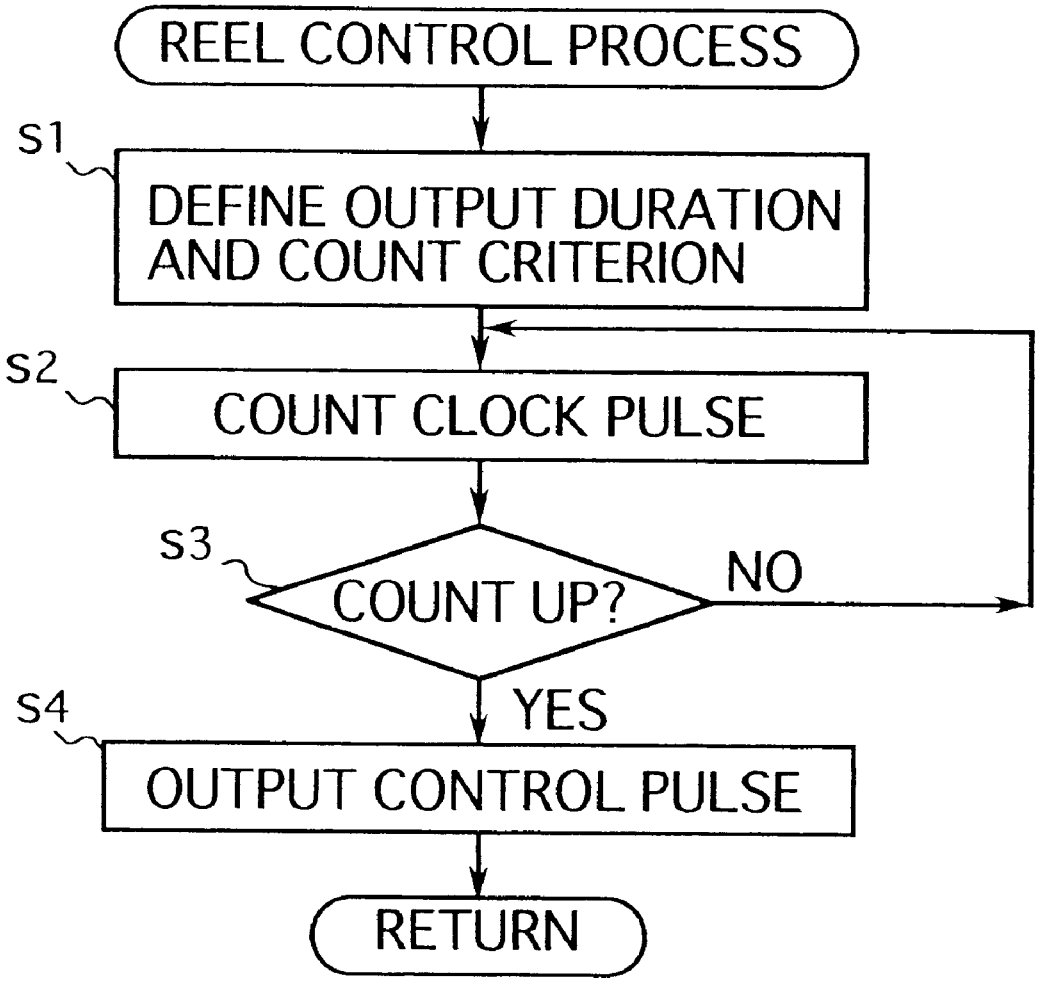
FIG. 7 is a flowchart showing the flow of the reel control process called by the step in the process shown in FIG. 6.
Figure 8:
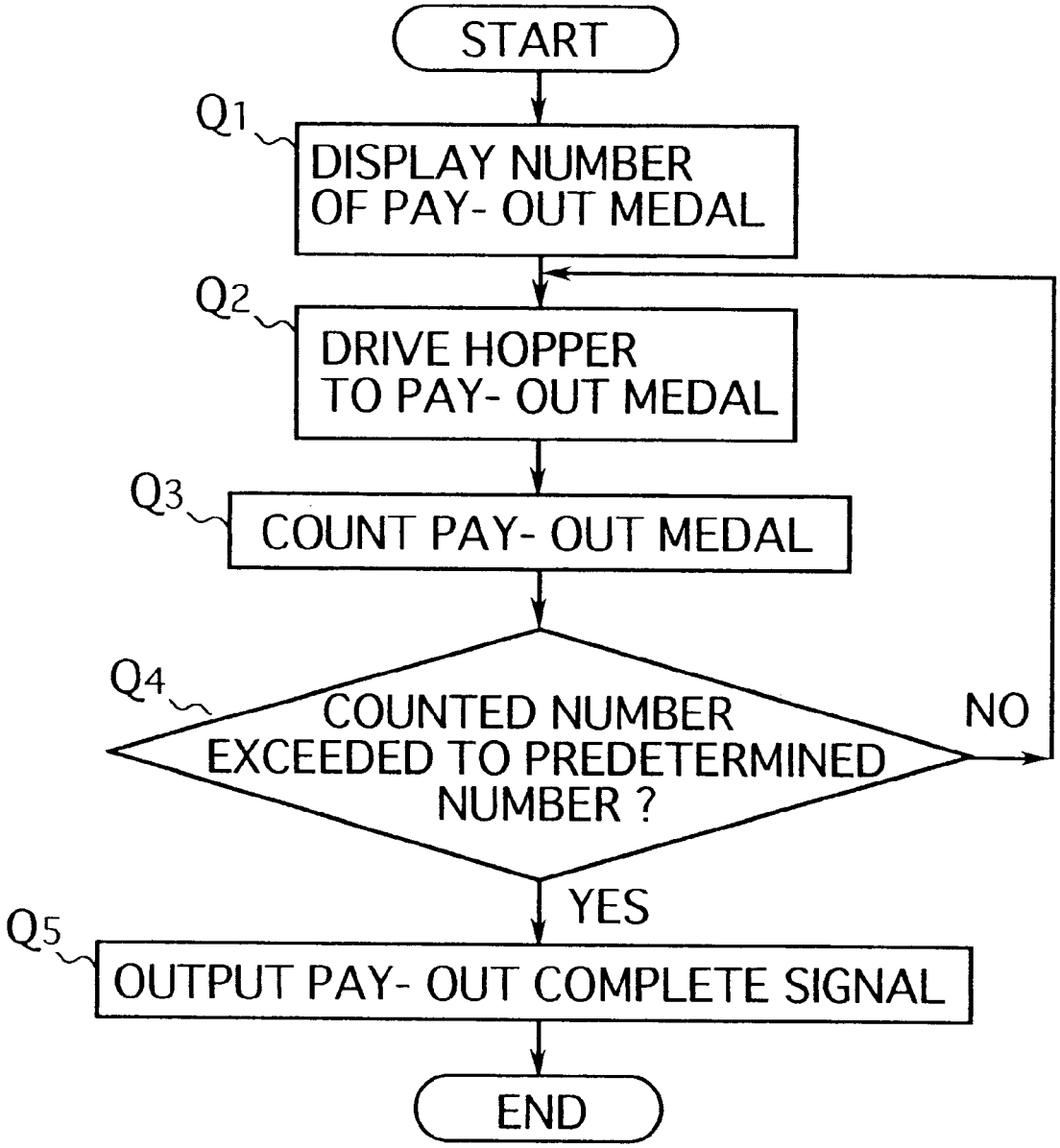
FIG. 8 is a flowchart showing the flow of the payout process of the game machine shown in FIG. 1.

Referring now to FIGS. 6 to 8 of the drawings, there is shown a method of controlling the game machine according to the present invention.

The above control unit 50 is operable to carry out the following process of controlling the slot machine 10 to allow the player to play the game. The control unit 50 is operated to repeat the steps P1 to P11 shown in FIG. 6 every game cycle. It is assumed that the game cycle begins at the time when the rotation of the reels is started in response to the start instruction and ends at the time when the three-symbols combinations positioned on the effective prize-winning lines are evaluate to award a prize.

In the step P1, the control unit 50 is operated to judge whether the game is required to start or not. The judgment is made on the basis of, for example, the start instruction signal transmitted from the start switch 61. When the answer in the step P1 is "YES", the step P1 proceeds to the step P2. When the answer in the step P1 is "NO", the control unit 50 is operated to wait for the request to start the game in the step P1.

In the step P2, the control unit 50 is operated to decide a plan of the result of the game by selecting one from among various cases previously defined and stored in a predetermined winning expectation table.

This operation of deciding the plan may be generally referred to as "operation of drawing a lottery". The winning expectation table is stored in the ROM 52 and indicative of a relationship between the random numbers and various result cases due to the three-symbols combinations. The result cases of the game include: for example, a first case where the game will failure because that the three-symbols combination is excluded from the prize-winning combinations; a second case where the game will win a small prize due to a predetermined specific symbol combination is gotten; a third case where the game will get a free game in which the player can play the game without investing the medals in betting; a fourth case where the game will get a predetermined bonus game; and so on. For instance, the bonus game has: a big bonus game, referred to as "BB" hereinlater; and a regular bonus game, referred to as "RB" hereinlater. In the BB game, the player can repeatedly play the games under a big bonus condition having a predetermined high dividend rate and a predetermined high expectation of winning thereby making it possible to successively at a predetermined successive times, e.g., 30 times, win a high prize. In the RB game, the player can play the game under a regular bonus condition having a predetermined high dividend rate and a predetermined high expectation of winning, thereby making it possible to win a high prize. In both of bonus games, the bonus conditions may be assumed after 15 medals are paid out. Under the BB condition, the player may further play a predetermined number of games, e.g., 3 games, under the RB condition.

The control unit 50 is operated to make the random number sampling circuit 59 sample the random number generated by the random number generator 58 at a predetermined timing, for example, when the start switch 61 is operated, and then to look up the winning expectation table stored in the ROM 52 to find the result of the game corresponding to the sampled random number. The plan of the aforesaid game result is thus decided.

In the step P3, the control is passed to a predetermined reel control process wherein the control unit 50 is operated to control the rotary operations of the reels 32A, 32B and 32C so that the symbols of the reels 32A, 32B and 32C can be scrolled within the windows 31*a*, 31*b* and 31*c*, respectively. The detailed description of the reel control process will be made later.

When the control is then returned from the reel control process to the step P3, the step P3 proceeds to the step P4 wherein the control unit 50 is operated to judge whether a predetermined time is passed after starting the rotations of the reels, or not. When the answer in the step P4 is "YES", the step P4 proceeds to the step P10. At this time, all of the reels should have been brought into a standstill already by the reel control process to make the three-symbols combinations corresponding to the effective prize-winning lines displayed on the symbol displaying area 31. When the answer in the step P4 is "NO", the step P4 proceeds to the step P5.

In the step P5, the control unit 50 is operated to judge whether any one of the stop instructions corresponding to the reels 32A, 32B and 32C is received from the reel stop signal circuit 76 or not. When the answer in the step P5 is "YES", the step P5 proceeds to the step P6. When the answer in the step P5 is "NO", the control is returned from the step P5 to the step P3.

In the step P6, the control unit 50 is operated to judge whether there is a chance to obtain the result of the game according to the plan decided in the step P2 or not.

More specifically, the judgment in the step P6 is made whether the present game will end in failure or win on the basis of the kinds of symbols respective positioned on the effective prize-winning lines when the corresponding reel is stopped rotating in response to the operated stop button. When the judgment is firstly made that the present game will win, the judgment is further made whether the symbols, which will be positioned on the effective prize-winning line, can constitute the decided winning combination or not.

In another embodiment, when the judgment is firstly made that the present game will win, the judgment is further made whether each combination of two symbols, which has been positioned on each effective prize-winning line, can constitute the decided winning combination or not. When the judgment is made that the combination of two symbols can constitute the decided winning combination, the judgment is further made whether a target symbol of the last rotating reel, which can constitute the decided winning combination in cooperation with the two symbols, can stand still on the effective prize-winning line or not.

This means that the control unit 50 is operated to calculate the position of the target symbol of the last rotating reel to judge whether the target symbol of the last reel is positioned within a predetermined range or not. The predetermined range may be assumed to be a predetermined maximum number of shifting symbols, e.g., 4 columns, deviated from the position on the effective prize-winning line when the stop button is operated to stop the rotation of the last rotating reel. This means that the target symbol of the last reel can be positioned on the effective prize-winning line after forwardly proceeding to the predetermined number of shifting symbols. Probably, the predetermined range may be assumed to be a predetermined rotary angle of the reel corresponding the number of shifting symbols.

In the step P7, the control unit 50 is operated to calculate the number of shifting symbols within the predetermined maximum number of shifting symbols. The control unit 50 is further operated to calculate a first rotary angle at which the reel is rotated in the first direction D1 and a second rotary angle at which the reel is rotated in the second direction D2 on the basis of the number of the shifting symbols. In this embodiment, the second direction D2 is opposite to the first direction D1. In another embodiment, the first and second directions D1 and D2 may cross at a predetermined angle, e.g., a right angle. The rotations at the first and second rotary angle will cause the target symbol of the reel to forwardly proceed to the predetermined number of shifting symbols to stand still on the effective prize-winning line.

In the following step P8, the control unit 50 is operated to allow the corresponding reel to start on the rotation stop operation by performing the reel control process and to rotate at the first rotary angle in the first direction D1 in order to shift the symbol of the reel before the rotation of the reel is completed. In the step P9, the control unit 50 is operated to allow the corresponding reel to further rotate at the second rotary angle in the second direction D2 in order to shift the symbol of the reel. Namely, the target symbol of the reel is slowly returned, if possible, to position at the effective prize-winning line. After the symbol is shifted in the first and second directions D1 and D2 in the steps P8 and P9, the symbol of the reel is shifted at the shifting number in the end. After stopping the reel, the step P9 proceeds to the step P10 wherein the control unit 50 is operated to judge whether all reels have been stopped already or not. When the answer in the step P10 is "YES", the step P10 proceeds to the step P11. When the answer in the step P10 is "NO", the control is returned from the step P10 to the step P3.

In another embodiment, when the number of the stationary reels, each of which has been stopped rotating already, exceeds to a predetermined number of reels, the steps P6 to P9 may be bypassed. The only remaining rotating reels may be stopped to rotate in accordance with the steps P6 to P9.

As shown in FIG. 7, the reel control process, which is called by the process of controlling the slot machine 10 shown in FIG. 6, comprises the steps s1 to s4. In the step s1, the control unit 50 is operated to decide the aforesaid pulse output duration for outputting each motor driving pulses and a count criterion according to a predetermined motor driving table stored in the ROM 52. The count criterion is used in the following step s3 for waiting an interrupt to allow the motor driving circuit 71 to output the motor driving pulses. As described above, the motor driving pulses are provided for the stepping motors 35A, 35B and 35C, respectively. The description of the representative operation of one of the stepping motors 35A, 35B and 35C will be made hereinlater.

In the step s2, the control unit 50 is operated to input, from the divider 57, the interrupt signal pulse which is obtained by dividing the base clock pulse transmitted from the clock generator 56 and to then count the number of the inputted interrupt signal pulses. In the step s3, the control unit 50 is operated to judge whether the number of the inputted interrupt signal pulses exceeds the count criterion or not. When the answer in the step s3 is "NO", the control unit 50 is operated to wait the number of the inputted interrupt signal pulses to exceed the count criterion. When the answer in the step s3 is "YES", the step s3 proceeds to the step s4 wherein the control unit 50 is operated to transmit a single control pulse to the motor driving circuit 71. The motor driving circuit 71 is then operated to generate the motor driving pulse in response to the control pulse transmitted from the control unit 50, thereby driving the stepping motors 35A, 35B and 35C corresponding to the reels 32A, 32B and 32C having no stop instruction received. The step s4 is completed, the control is returned to the process shown in FIG. 6.

The above reel control process is repeatedly called by the step P3 of the process shown in FIG. 6 to leads to the fact that the reel can be gradually regulated by the pulse duration and the count criterion to reduce or increase in the rotary speed, thereby causing the reels to be accelerated for a first predetermined time, then to be rotated at a constant speed for a second predetermined time, and to be decelerated for a third predetermined time to be finally stopped. In this embodiment, the reel control process is a sub procedure called from the main procedure. In particular, the reel control process may be regularly performed in a multi-task system.

Furthermore, the reel control process may be called by the step P7 of the process shown in FIG. 6 in order to decelerate the reel to stop rotating.

The slot machine 10 is further operated to carry out the following pay-out process of paying out the medals after evaluating the three-symbols combination to obtain the result of the game in the step P11 shown in FIG. 6. The pay-out process comprises the steps Q1 to Q5 as shown in FIG. 8.

In the step Q1, the control unit 50 is operated to output a medal number indicating signal to the display driving circuit 73 to allow the display unit 23 to display the number of awarding medals for winning a prize in accordance with the result of the game obtained in the above process. In the following step Q2, the control unit 50 is operated to output a predetermined instruction signal to the hopper driving circuit 72 to make the hopper 81 pay-out the awarding medals for winning the prize. While the medals are extracted from the hopper 81, the medal sensing unit 82 is operated to sense the medals extracted from the hopper 81 in the step Q3. At the same time, the pay-out signal circuit 78 is operated to count the pay-out medals according the signal inputted from the medal sensing unit 82 in the step Q3. In the step Q4, the pay-out signal circuit 78 is operated to judge whether the counted number of the pay-out medals exceeds to the number indicative of the medal number indicating signal or not. When the answer is "YES" in the step Q4, the step Q4 proceeds to the step Q5. When the answer is "NO" in the step Q4, the control is returned from the step Q4 to the step Q2. The above steps Q2 to Q4 are repeatedly performed to pay-out the medals until the number of the pay-out medals exceeds to the number of the awarding medals.

In the step Q5, the pay-out signal circuit 78 is operated to output the pay-out complete signal to the control unit 50. The control unit 50 is operated to receive the pay-out complete signal transmitted from the pay-out signal circuit 78 and to allow the hopper 81 to stop the pay-out by way of the hopper driving circuit 72. Then the pay-out process is completed.

When the player operates the start lever 42, the start instruction is transmitted to the microcomputer 54 to cause all reels to rotate in the first direction D1. The reels 32A, 32B and 32C are gradually decelerated to stop rotating when a predetermined time is passed after the reel is started to rotate. Before the predetermined time is passed, the stop buttons 41*a*, 41*b* and 41*c* are operated by the player, the stop instructions are transmitted to the microcomputer 54 to cause the rotations of the reels 32A, 32B and 32C, respectively, to be stopped.

At this time, the control unit 50 is operated to determine whether the reel is rotated in the second direction D2 after the reel is stopped rotating in the first direction D1 or not. The control unit 50 can be further operated to calculate the number of shifting symbols on the basis of the position of the symbol of the reel, the plan of the game result, the symbol combination on the effective prize-winning line, and so on.

Figure 9:
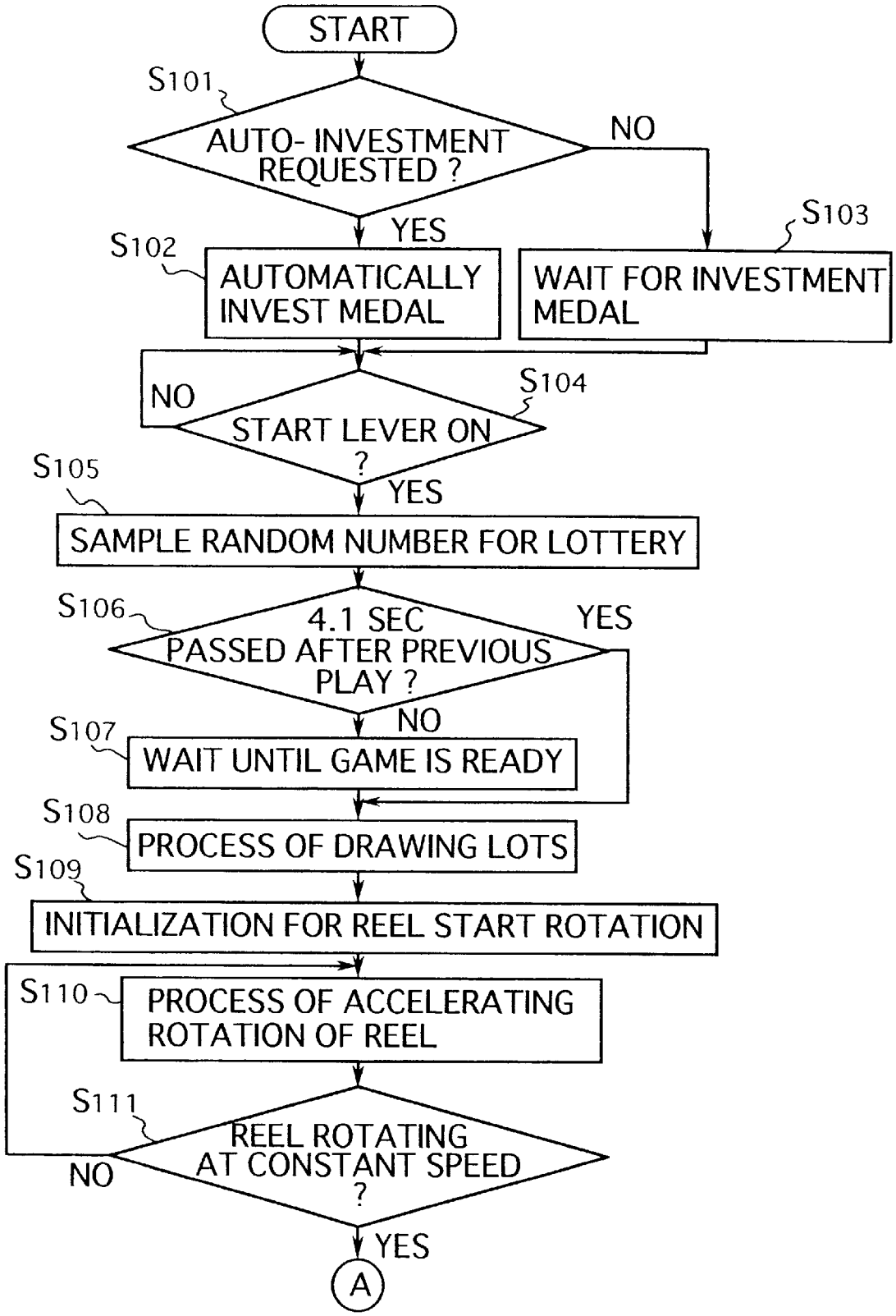
FIG. 9 is a flowchart showing the flow of a main routine of the program executed by the microcomputer of the game machine shown in FIG. 1.
Figure 10:
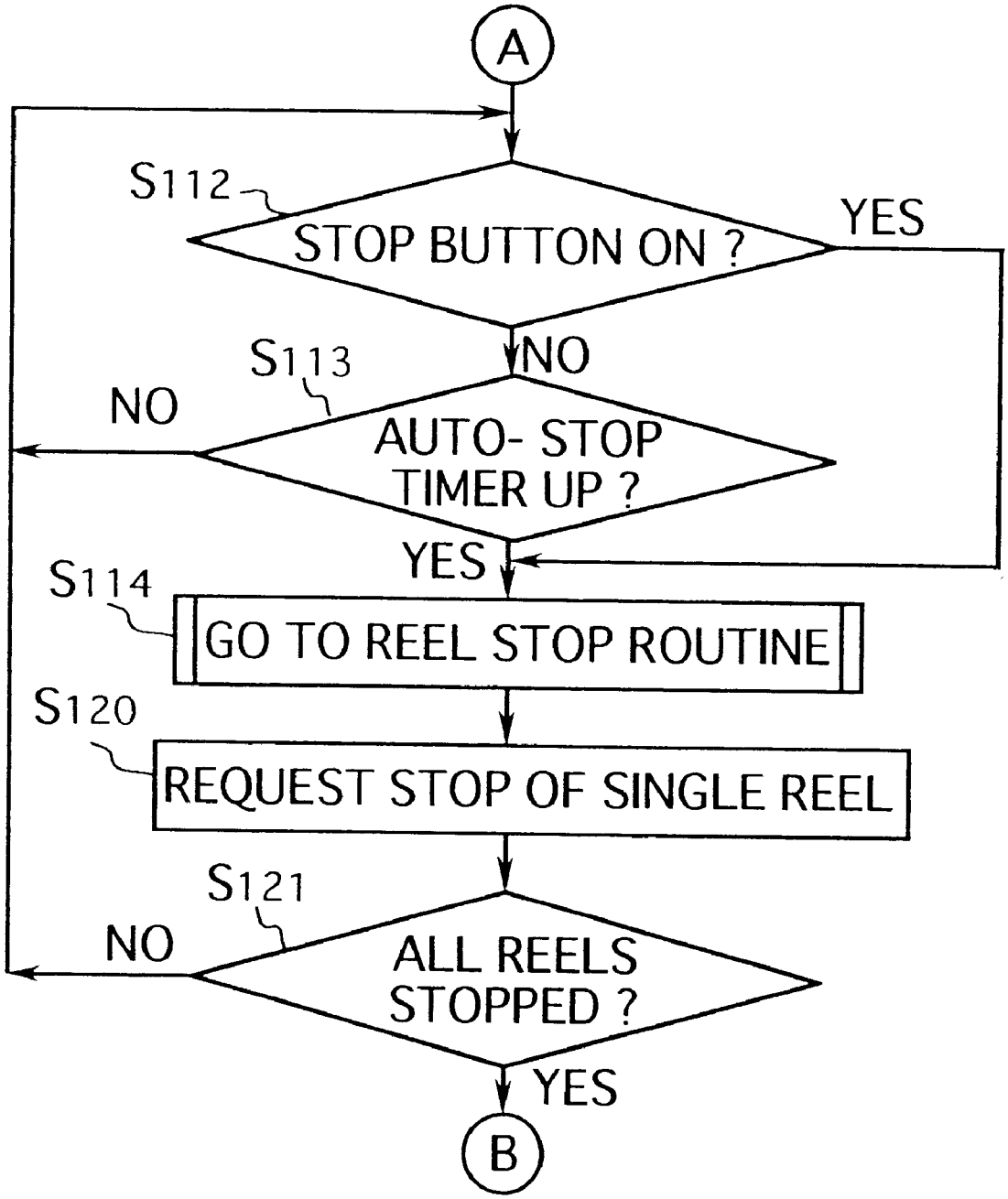
FIG. 10 is a flowchart followed by the steps of the program shown in FIG. 9.
Figure 11:
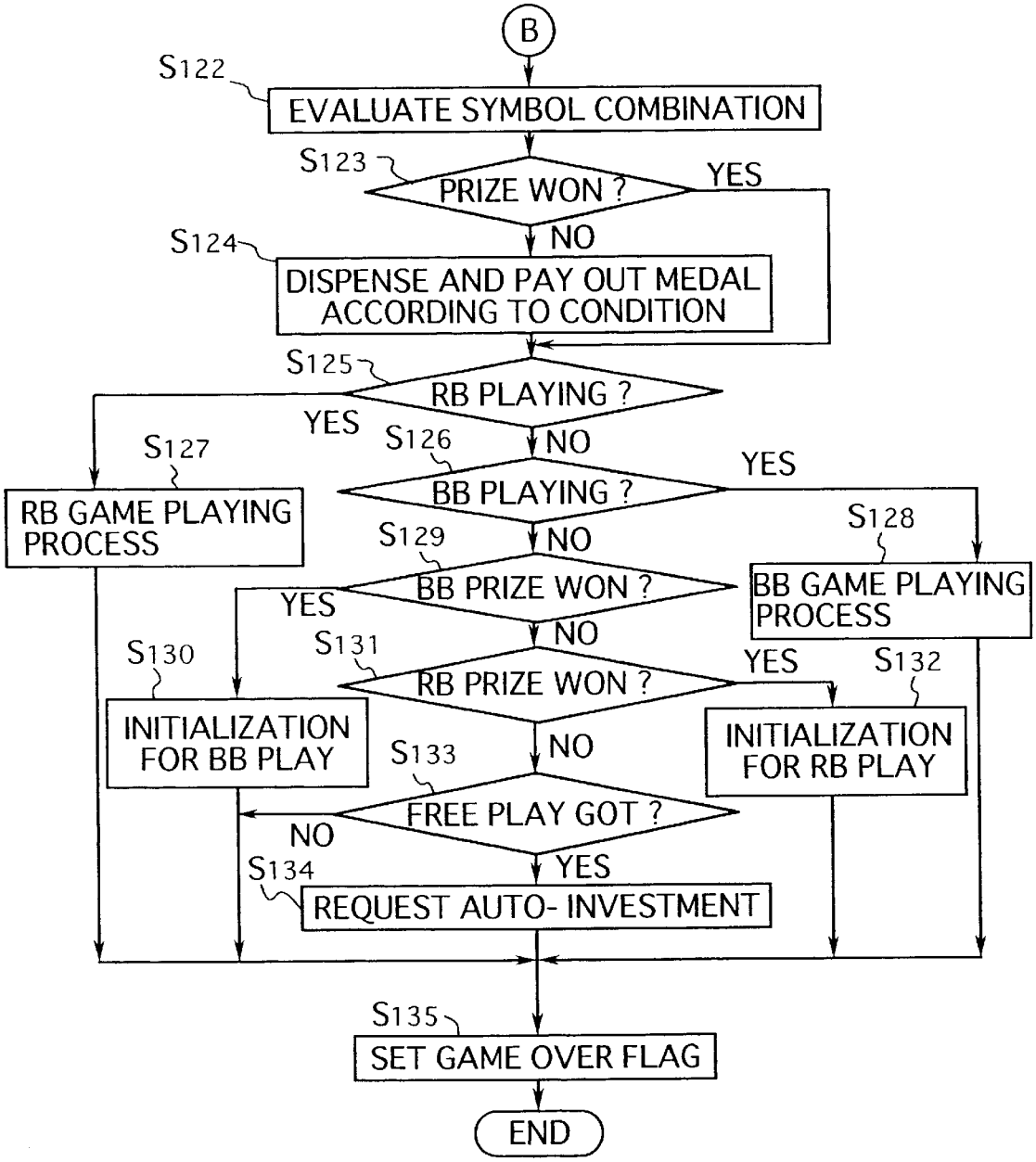
FIG. 11 is a flowchart followed by the steps of the program shown in FIG. 10.

Referring to FIGS. 9 to 11 of the drawings, there is shown a flowchart of a main routine of a game program of controlling the slot machine 10 executed by the microcomputer 54, so that the aforesaid process of controlling the game machine according to the present invention can be performed. After turning on power to activate the slot machine 10, the microcomputer 54 is firstly operated to check a predetermined memory area and to initialize a predetermined output port and then start a predetermined initializing procedure in the game program of controlling the slot machine 10 to get the slot machine 10 ready for playing the game, not shown.

As shown in FIG. 9, in the step S101, the microcomputer 54 is operated to judge whether there is an automatically investing request or not. The automatically investing request may be generated when the player selectively operates the medal investing buttons 43*a*, 43*b* and 43*c*. Moreover, automatically investing request may be generated when the previous game got the free game. When the answer in the step S101 is "YES", the step S101 proceeds to the step S102 wherein the microcomputer 54 is operated to perform a predetermined investing process of automatically investing the medals corresponding to the requested number of medals in betting corresponding to the selected medal investing buttons 43*a*, 43*b* and 43*c*. When the previous game got the free game, the number of medals may be equal to that of the previous game. The step S102 then proceeds to the step S104.

When the answer in the step S101 is "NO", the step S101 proceeds to the step S103 wherein the microcomputer 54 is operated to wait for the insertion of the medals through the medal inlet port 45. More specifically, when the player inserts one medal to the slot machine 10 through the medal inlet port 45, only the center winning line L1 is made effective in betting. At this time, the investing medal number indicating unit 21*a* is turned on, thereby allowing the player to recognize this line to be effective in betting. When the player inserts two medals to the slot machine 10 through the medal inlet port 45, the upper and lower winning lines L2A and L2B are made effective in betting in addition to the center winning line L1. At this time, the investing medal number indicating unit 21*b* as well as 21*a* are turned on, thereby allowing the player to recognize these lines to be effective in betting. When player inserts three medals to the slot machine 10 through the medal inlet port 45, all of the winning lines L1, L2A, L2B, L3A and L3B are made effective in betting. At this time, all of the investing medal number indicating units 21*a*, 21*b* and 21*c* are turned on, thereby allowing the player to recognize these lines to be effective in betting.

In the step S103, the number of medals for betting is limited to three medals in a normal game playing, while the number of medals for betting is limited to one medal in a RB game playing. The microcomputer 54 is operated to perform another predetermined investing process of investing the inserted medals in betting for the present game. Then the step S103 proceeds to the step S104.

In the step S104, the microcomputer 54 is operated to judge whether the start lever 42 is operated or not on the basis of the predetermined input signal transmitted from the start switch 61. When the answer in the step S104 is "YES", the step S104 proceeds to the step S105. The microcomputer 54 is operated to wait in the step S104 until the player operates the start lever 42.

In the step S105, the microcomputer 54 is operated to sample a single random number for the operation of drawing a lottery from the random number sampling circuit 59 as described above. The sampled random number is temporarily stored in the RAM 53 in order to be used for decision on a plan of the result of the game in the later step S108.

In the step S106, the microcomputer 54 is operated to judge whether a predetermined waiting time is passed after starting the previous game or not. When the answer in the step S106 is "YES", the step S106 proceeds to the step S108. When the answer in the step S106 is "NO", the step S106 proceeds to the step S107 wherein the microcomputer 54 is operated to wait until the predetermined waiting time, for example, 4.1 msec, is passed after starting the previous game. The step S107 proceeds to the step S108, when the predetermined waiting time is over.

In the step S108, the microcomputer 54 is operated to look up the winning expectation table to find out the result of the present game in accordance with the random number stored in the RAM 53 in the step 105. The predetermined winning expectation table is previously stored in the ROM 52 as described above. On the basis of the obtained result, the microcomputer 54 is operated to have a plurality of predetermined flags respectively set or reset. These flags are temporarily stored in a predetermined winning request area in the RAM 53. In response to the set of the respective flags in the winning request area, a predetermined winning request signal corresponding to the set flag is generated.

More specifically, the microcomputer 54 is operated to judge whether the sampled random number is included within a predetermined prize-winning range of the winning expectation table or not. When the judgment is made that the sampled random number is included within the predetermined prize-winning range of the winning expectation table, the microcomputer 54 is then operated to set the corresponding flag to produce the winning request signal. When, on the other hand, the judgment is made that the sampled random number is excluded from the predetermined prize-winning range of the winning expectation table, the microcomputer 54 is then operated to reset the corresponding flag.

Referring to FIG. 13, there is shown an example of the winning request area A1 including six flags, for example, "failure" indicative that the game will be failure, "bullet" indicative that the game will get the combination of three bullet symbols, "bell" indicative that the game will get the combination of three bell symbols, "free game" indicative that the game will get the free game, "RB" indicative that the game will get the RB game, and "BB" indicative that the game will get the BB game, when respective these flags are set to "1". In case of FIG. 13, the bell flag is set to "1" wherein the game will be get the combination of three bell symbols.

As described above, at the time of detecting the start operation in the step S104, the slot machine 10 is operated to perform the reel rotating process when the start lever 42 is operated. The CPU 51 is operated to output a predetermined control signal, such as the motor driving pulse, to the motor driving circuit 71 in response to the predetermined start instruction signal transmitted from the start switch 61 by sensing the operation of the start lever 42. The motor driving circuit 71 is operated to drive the 35 stepping motors 35A, 35B and 35C to have the reels 32A, 32B and 32C, respectively, rotated.

The reel rotating process is performed by the microcomputer 54 in the following steps S109 to S111 in FIG. 9. In the step S109, the microcomputer 54 is operated to perform a predetermined initialization process to start rotating the reels 32A, 32B and 32C. The step S109 proceeds to the step S110 wherein the aforesaid reel rotating process is performed to start and accelerate the rotation of the reels 32A, 32B and 32C.

More specifically, the microcomputer 54 is operated to accelerate the rotation of the reels 32A, 32B and 32C at a predetermined degree, i.e., at variable speed increased in accordance with a predetermined rate pitch. After the reels 32A, 32B and 32C have been rotated at a predetermined constant speed, the microcomputer 54 is operated to control the reels 32A, 32B and 32C to rotate at the constant speed.

In the reel rotating process, the microcomputer 54 is further operated to count the motor driving pulses supplied to each of the stepping motors 35A, 35B and 35C after starting the rotations of the reels 32A, 32B and 32C. The microcomputer 54 is then operated to temporarily store the counts of the respective reels 32A, 32B and 32C in the RAM 53. At the same time, the CPU 51 is operated to input the predetermined reset pulses of each of the reels 32A, 32B and 32C transmitted from the reel position sensing circuit 77 to clear the stored counts corresponding to the reels 32A, 32B and 32C, respectively, to zero. Accordingly, the positions of the rotating reels 32A, 32B and 32C can be represented as the counts of the reels 32A, 32B and 32C per the total counts of one rotation.

In the step S111, the microcomputer 54 is operated to judge whether the rotating speed of each of the reels 32A, 32B and 32C exceeds to the predetermined constant speed or not. The predetermined constant speed may be a first rotating speed indicative of r1 (rotation counts/min). When the answer in the step S111 is "YES", the step S111 proceeds to the step S112 shown in FIG. 10. When the answer in the step S112 is "NO", the control is returned from the step S111 to the step S110. Thus, the reels 32A, 32B and 32C are accelerated at the predetermined degree until the rotating speed of the reels 32A, 32B and 32C exceeds to the constant speed, after starting the rotate of the reels 32A, 32B and 32C. When the rotating speed of the reels 32A, 32B and 32C exceeds to the constant speed, the operations of the stop buttons 41*a*, 41*b* and 41*c* are then enabled.

As shown in FIG. 10, the microcomputer 54 is then operated to judge whether any one of the stop buttons 41*a*, 41*b* and 41*c* is pushed by the player or not in the step S112, and further judge whether a predetermined reel operating time, e.g., 40 sec, is passed after starting the rotate of the reels or not in the step S113. The judgment is made in the step S113 by judging whether a predetermined auto-stop timer for automatically counting the predetermined reel operating time down to zero is set after starting the rotation and counts down to zero or not. When the answer in either the step S112 or S113 is "YES", the control goes to the step S114 wherein a predetermined reel stopping process routine is called. When the answer in both the step S112 and S113 are "NO", the control is returned from the step S113 to the step S112. The description of the reel stopping process routine called by the step S114 will be made later The control is then returned from the reel stopping process routine to the step S120 wherein the microcomputer 54 is operated to set a predetermined reel stop requests for the reels 32A, 32B and 32C corresponding to the pushed stop button 41*a*, 41*b* and 41*c*, respectively. In the step S121, the microcomputer 54 is operated to judge whether all of the reels 32A, 32B and 32C are stopped or not. This judgment is not only made by checking whether all of the reels 32A, 32B and 32C have been entirely stopped or not, but also checking whether the reel stop requests are set or not before the reels have been entirely stopped. When the answer in the step S121 is "YES", the step S121 proceeds to the step S122 shown in FIG. 11. When the answer in the step S121 is "NO", the control is returned from the step S121 to the step S112. In this case, the slot machine 10 is operated to repeat the process including the step S112 to S121 until the judgment in the step S121 is made "YES".

As shown in FIG. 11, in the step S122, the microcomputer 54 is operated to evaluate the three-symbols combinations respective positioned on the effective winning lines by searching various predetermined winning combinations. The microcomputer 54 is operated to decide the number of medals for awarding a prize according to the kind of winning combinations.

In the following step S123, the microcomputer 54 is operated to judge whether there is no medal for awarding a prize or not. When the answer in the step S123 is "YES", the step S123 proceeds to the step S125. When the answer in the step S123 is "NO", the step S123 proceeds to the step S124 wherein the microcomputer 54 is operated to select the method of paying out medals from among the methods of: reserving the pay-out medal for the credit; and particularly paying out medals outside. This selection of the pay-out method is previously determined in accordance with a predetermined mode selecting button, such as a dip switch, not shown and included in the slot machine 10.

In the step S125, the microcomputer 54 is operated to judge whether the slot machine 10 operates under the RB game condition or not. When the answer in the step 125 is "YES", the step S125 proceeds to the step S127 wherein a predetermined RB game playing process is performed. When the answer in the step S125 is "NO", the step S125 proceeds to the step S126 wherein the microcomputer 54 is operated to judge whether the slot machine 10 operates under the BB game condition or not. When the answer in the step 126 is "YES", the step S126 proceeds to the step S128 wherein a predetermined BB game playing process is performed. When the answer in the step S126 is "NO", i.e., the slot machine 10 operates under the normal game condition except both of BB and RB game conditions, the step S126 proceeds to the step S129 wherein the microcomputer 54 is operated to judge whether the present game win a prize for BB game or not. When the answer in the step 129 is "YES", the step S129 proceeds to the step S130. When the answer in the step S129 is "NO", the step S129 proceeds to the step S131 wherein the microcomputer 54 is operated to judge whether the present game win a prize for RB game or not. When the answer in the step 131 is "YES", the step S131 proceeds to the step S132. When the answer in the step S131 is "NO", the step S131 proceeds to the step S133. In the steps S130 and 132, the microcomputer 54 is operated to set predetermined BB and RB enable flags to "1", respectively. In response to the enabled BB and RB enable flags, the microcomputer 54 is operated to initialize various information on the BB and RB games in predetermined data areas, thereby causing the slot machine 10 can operate under the BB and RB game conditions, respectively. The steps S127, S128, S130 and S132 then proceed to the step S135.

When the judgments in both of step S129 and S131 are made that no bonus game is gotten, the microcomputer 54 is operated to judge whether the present game win a prize for the free game or not in the step S133. When the answer in the step 133 is "YES", the step S133 proceeds to the step S134 wherein the microcomputer 54 is operated to set a free game request flag. In response to the request made by setting the free game request flag, the microcomputer 54 is operated to request the automatically inventing medal for the free game. When the answer in the step S133 is "NO", the step S133 proceeds to the step S135 wherein the microcomputer 54 is operated to set a flag indicative that a single game routine is completed.

Figure 12:
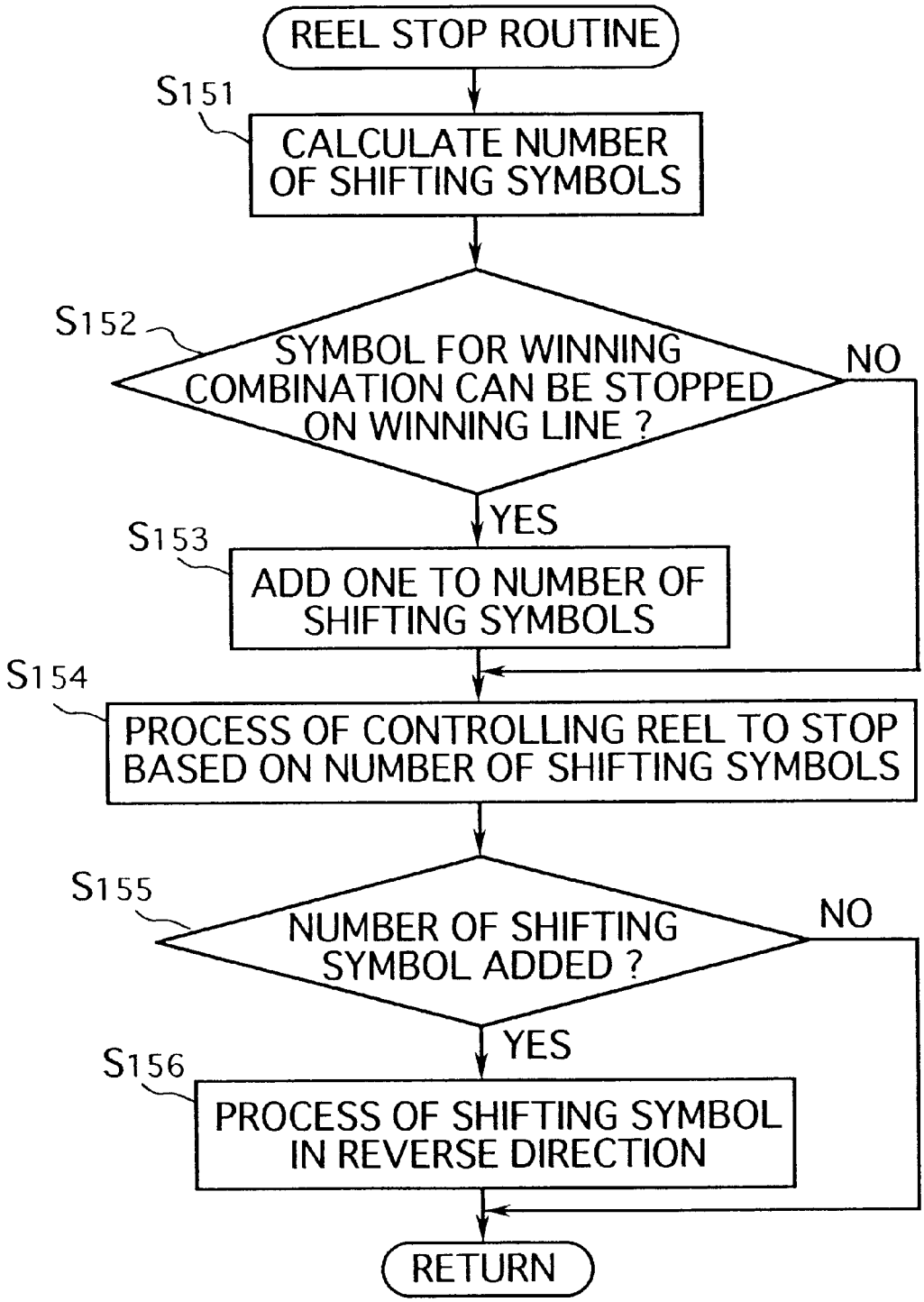
FIG. 12 is a flowchart showing the flow of the first embodiment of the reel stopping process routine called by the step of the program shown in FIG. 10.

Referring to FIG. 12 of the drawings, there is shown a first example of the reel stopping process routine of controlling to stop the rotation of the reels. As shown in FIG. 12, the reel stopping process routine comprises the steps S151 to S156.

In the step S151, the microcomputer 54 is operated to calculate the number of shifting symbols. The number of shifting symbols is determined on the basis of the various information including: the flags in the winning request area; the value read out from a predetermined refresh register (R-register) when each stop button is operated; the present positions of the reels (or the positions of the target symbols) and so on. The number of shifting symbols is defined as the number of symbols which can be shifted to have the target symbol positioned on the effective prize-winning line within a predetermined time duration, e.g., 190 msec, provided for in the present law, after detecting the stop operation for the reel. In case when the symbols are shifted only in the first direction D1, the number of shifting symbols may be limited to four symbols. The R-register is designed to refresh data in the register cyclically varied from 0 to a predetermined value at high speed.

In the following step S152, the microcomputer 54 is operated to judge whether the target symbol for the winning combination can be stopped on the effective prize-winning line or not. This judgment is made on the basis of the flags in the winning request area, i.e., whether any one of the flags including the three "bell" or "bullet" symbols combination flag, the RB game flag, and the BB game flag are set or not. When the answer in the step S152 is "YES", the step S152 proceeds to the step S153. When the answer in the step S152 is "NO", the step S152 proceeds to the step S154.

In the step S153, the microcomputer 54 is operated to add a predetermined additional value, e.g., one, to the number of shifting symbols. In the following step 154, the microcomputer 54 is operated to perform the reel stopping process wherein the reel is rotated in the first direction D1 to shift the symbol of the reel on the basis of the number of shifting symbols obtained in the step S152 or S153.

In the following step S155, the microcomputer 54 is operated to judge whether the addition of the number of shifting symbols is performed in the step S153 or not. When the answer in the step S155 is "YES", the step S155 proceeds to the step S156. When the answer in the step S155 is "NO", the control is returned to the main routine. In the step S156, the microcomputer 54 is operated to perform the reel stopping process wherein the reel is rotated in the second direction D2 to shift the symbol of the reel on the basis of the predetermined additional value for adding the number of shifting symbols. After rotating the symbols in the first and second directions D1 and D2 in the steps S154 and S156, the target symbol of the reel is brought to a standstill on the effective prize-winning line to decide the three-symbols combination.

The description of the operation of the slot machine 10 in accordance with the game program shown in FIGS. 9 to 12 will be made hereinlater.

The microcomputer 54 is operated to starts to execute the game program after performing the predetermined initializing procedure as described above. When the player inserts three medals into the slot machine 10 through the medal inlet port 45, there is no investing request. The judgment is made in the step S101, shown in FIG. 9, that there is no automatically investing request, therefore, the step S101 proceeds to the step S103 wherein all of the investing medal number indicating units 21*a*, 21*b* and 21*c* are lighted up and the inventing medal number is set to three, i.e., all of prize-winning lines are effective in betting.

When the player operates the start lever 42, the step S104 proceeds to the step S105 wherein a single random number for the operation of drawing a lottery is sampled from the random number sampling circuit 59 and then the sampled random number is temporarily stored in the RAM 53.

When 4.1 seconds have been passed after starting the previous game, the plan of the result of the present game is found out by looking up the winning expectation table in accordance with the random number stored in the RAM 53 in the step S105.

The plan of the game result corresponding to sampled random number is assumed that the winning combination will get the combination consisting of three "bell" symbols. In this case, the "bell" flag of the winning request area A1 is set to "1", the other flags are reset to "0" as shown in FIG. 13, and then the winning request area A1 is stored in the RAM 53. In response to this operation, the winning request signal is generated.

When the player operates the start lever 42, the reel rotating process is performed to make all reels 32A, 32B and 32C rotated in the first direction D1 and accelerated at the predetermined degree in the steps S109 and S110. When the rotating speed of each of the reels 32A, 32B and 32C exceeds to the predetermined constant speed, the step S111 proceeds to the step S112 shown in FIG. 10 wherein the operations of the stop buttons 41*a*, 41*b*and 41*c*becomes to be enabled.

Figure 14:
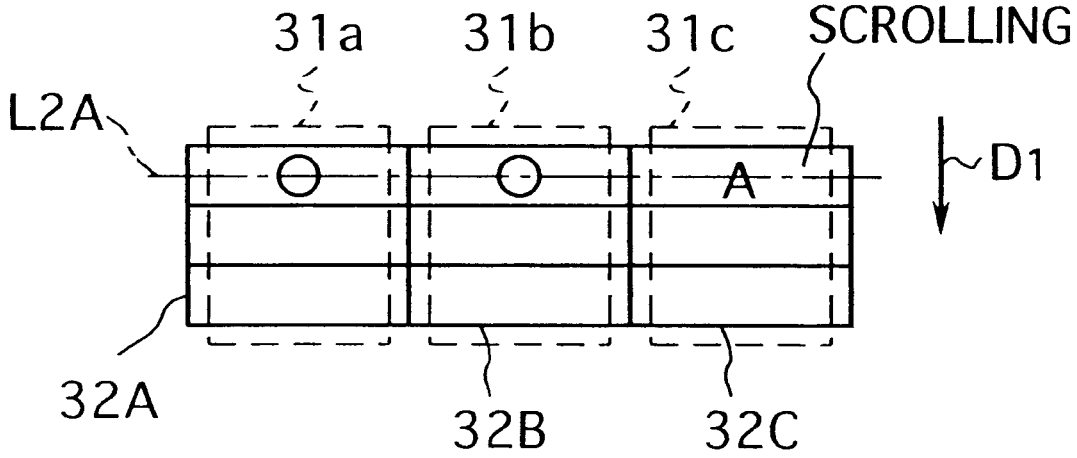
FIG. 14 is a schematic diagram showing the positions of the symbols of the reels of the game machine shown in FIG. 1 when the last reel is rotating in the first direction and two reels have been stopped rotating.

Firstly, The player operates the stop button 41*a*, thereby calling the reel stopping routine in FIG. 12. In the step S151, the number of shifting symbols is calculated. In this case, if possible, the reel 32A is controlled to stop rotating so that the target symbol for winning combination, i.e., "bell" symbol, will be placed on either one of the effective winning lines due to the winning request signal. It is assumed that the target symbol can be stopped on the winning line L2A. The judgment is made in the step S152 that the target symbol for winning combination can be stopped on the effective winning lines, thereby causing the step S152 to proceed to the step S153. In the step S153, one is added to the number of the shifting symbols. Then the step S153 proceeds to the step S154, the reel 32A is controlled to make the target symbol shift in the first direction D1 before stopping the forward rotation of the reel 32A. The step S154 further proceeds to the step S156 by way of the step S155. In the step S156, the reel 32A is controlled to further rotate backward thereby making the target symbol shift in the second direction D2. Consequently, the "bell" symbol is placed on the winning line L2A as shown in FIG. 14 after shifting the symbol of the reel 32A in the reverse direction. Here, the symbols "○" denotes the "bell" symbols in FIG. 14.

If the judgment is made in the step S152 that the target symbol for winning symbol can not be stopped on the effective winning lines, the steps S153 and S156 are bypassed, so that the reel 32A is controlled to stop rotating without process of shifting the symbols in reverse direction.

After completing the reel stopping process routine, the control is returned to the step S120 of the main routine shown in FIG. 10. The reel stop request corresponding the reel 32A is then set in the step S120. By way of the step S121, the operation of the stop buttons is waited in the step S12.

Next, the player operates the stop button 41*b*, thereby bringing the rotation of the reel 32B to a standstill by way of the same processes as described above. It is assumed that the "bell"symbol "○"is also place on the winning line L2A, as shown in FIG. 14, after the symbol of the reel 32B is shifted in the reverse direction.

After completing the reel stopping process routine, the control is returned to the step S120 of the main routine shown in FIG. 10. The reel stop request corresponding the reel 32B is then set in the step S120. By way of the step S121, the operation of the stop buttons is waited in the step S112.

Figure 15:
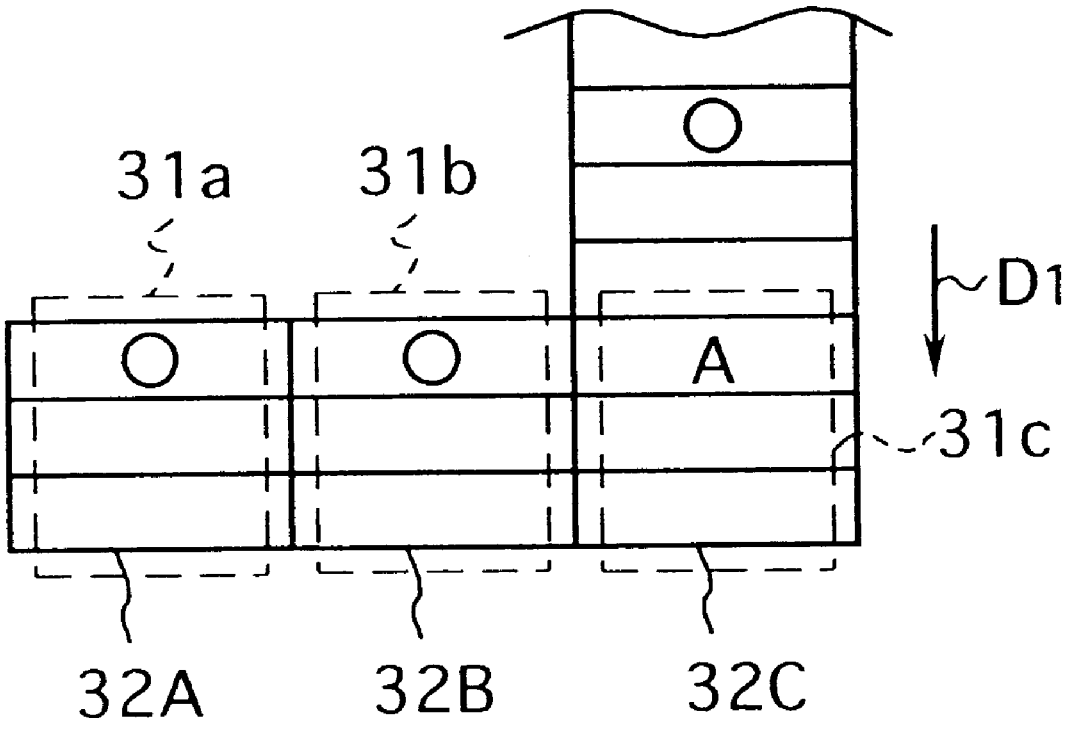
FIG. 15 is a schematic diagram showing the position of the target symbol in the situation shown in FIG. 14.

After the two "bell"symbols "○"of the reels 32A and 32B are positioned on the effective winning line L2A as shown in FIG. 14, the player operates the stop button 41*c*to stop rotating the reel 32C. At this time, the step Si 12 proceeds to the step S114 wherein the reel stopping process routine is called. In the reel stopping process routine shown in FIG. 12, the number of shifting symbols is calculated in the step S151. It is assumed that the target symbol, i.e., "bell"symbol "○", of the reel 32C is placed at the position behind three columns from that of symbol "A"as shown in FIG. 15 when the stop button 41*c* is operated by the player. The number of shifting symbols is set to three in the step S151 in order to control the reel 32C to have the target symbol "○" positioned on the effective winning lines.

Figure 16:
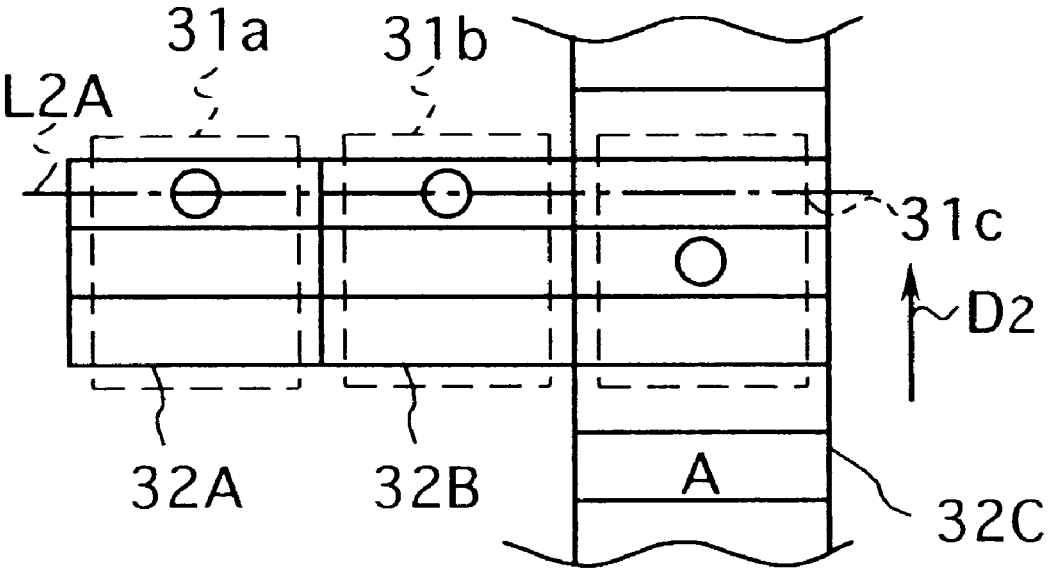
FIG. 16 is a schematic diagram showing the positions of the symbols of the reels of the game machine before the last reel is shifting symbols in the second direction after shifting in the first direction.
Figure 17:
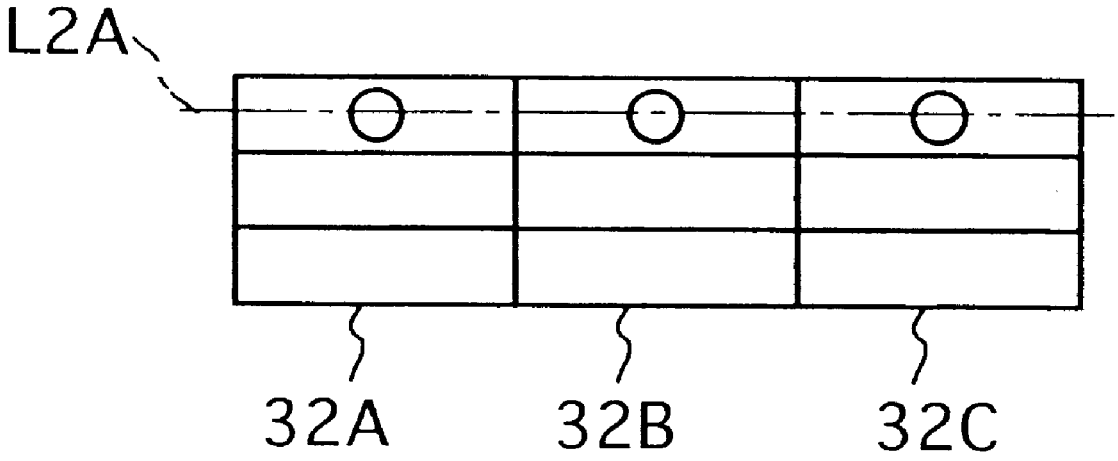
FIG. 17 is a schematic diagram showing the positions of the symbols of the reels of the game machine after all reels stop rotating.

Accordingly, the judgment is made in the step S152 that the target symbol can be stopped on the effective winning line L2A. Then one is added to the number of shifting symbols in the step S153. Consequently, the number of shifting symbols is set to four. The reel 32C is then controlled in the step S154 to shift the symbol "A" to the position over the number of shifting symbols, i.e., four columns, so that the reel 32C can stop the forward rotation after running the target symbol "○" over the effective prize-winning line L2A as shown in FIG. 16. Immediately, the reel 32C is controlled in the step S156 to start the backward rotation to shift the target symbol "○" in the second direction D2 to the position on the winning line L2A. Thus, the three "bell" symbols are positioned on the effective winning line L2A after stopping the rotation of all reels as shown in FIG. 17.

After completing the reel stopping process routine, the control is returned to the step S120 of the main routine shown in FIG. 10. The reel stop request corresponding the reel 32C is then set in the step S120. Because that all of the reels 32A, 32B and 32C are stopped, the step S121 proceeds to the step S122 wherein the combinations of symbols positioned on the effective winning lines, in this case all winning lines L1, L2A, L2B, L3A and L3B, are evaluated.

Because that the three "bell" symbols are positioned on the winning line L2A to form the winning combination, the present game win a prize. Therefore, the step S123 proceeds to the step S125. In the judgments made in the following steps S125, S126, S129 and S131, all of the answers are "NO". Therefore, the step S125 proceeds to the step S135 wherein the flag indicative that a single game is completed.

The player can continuously play the game, when the main routine of the program of controlling the game machine is repeatedly recalled.

Figures 18A, 18B, 18C, 18D:
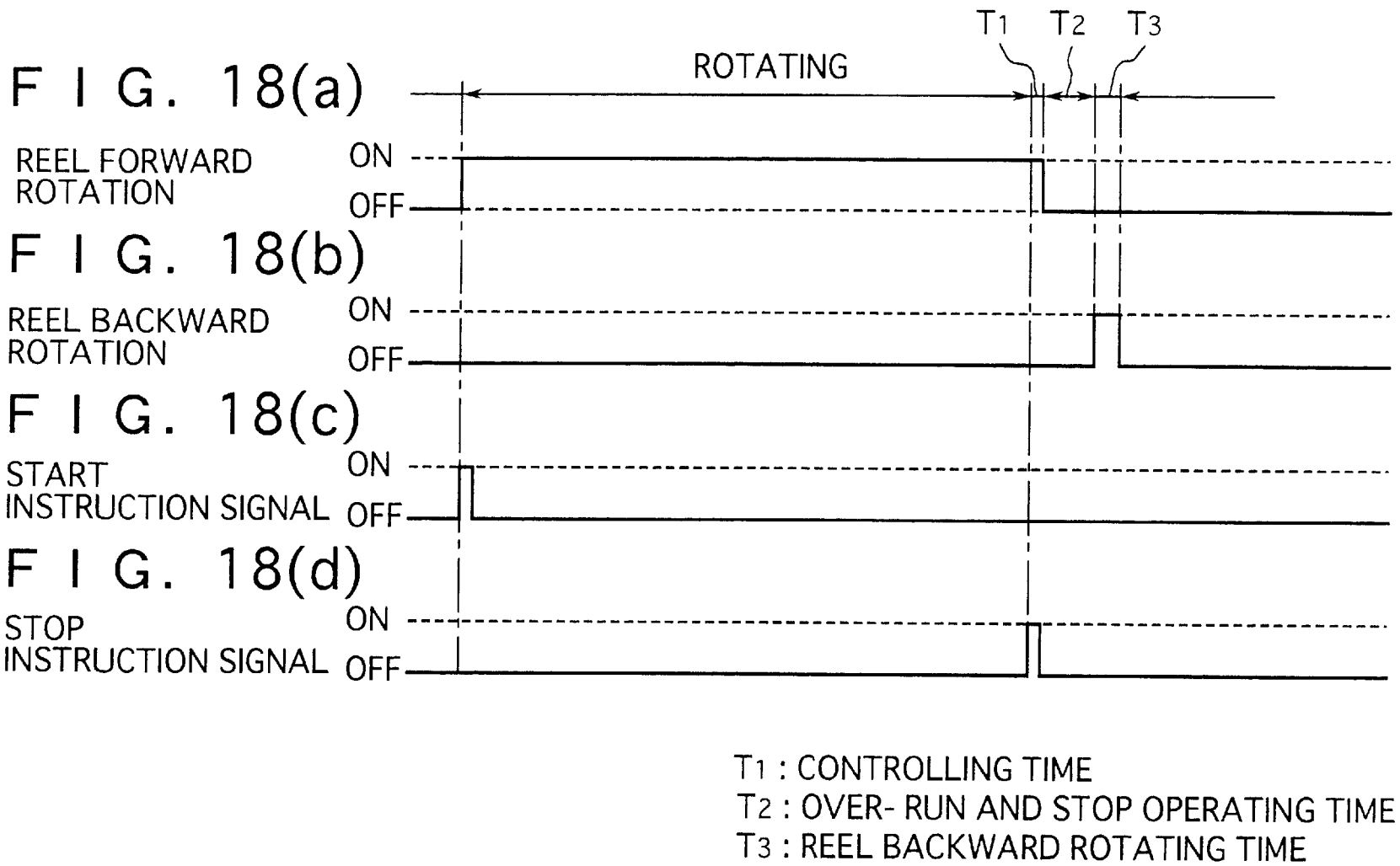
FIG. 18(*a*) is a timing chart of the forward rotation of the reel of the game machine shown in FIG. 1.

Referring to FIGS. 18(*a*) to 18(*d*), there is shown a timing chart of the above operation of the reels. In response to the operation of the start lever 42, the start instruction signal is set to "1" as shown in FIG. 18(*c*). When the edge of the risen start instruction signal is detected, the reels 32A, 32B and 32C being to forwardly rotate in the first direction D1 as shown in FIG. 18(*a*). When the stop button 41cis operated to allow the reel stop signal circuit 76 to generate the stop instruction signal corresponding to the reel 32C, the edge of the stop instruction signal is detected as shown in FIG. 18(*d*). In response to this detection, the number of the shifting symbols is calculated and the judgment is made whether the backward rotation should be performed or not. When the judgment is made that the backward rotation should not be performed, the reel 32C is controlled to stop rotating in the first direction D1 to bring the target symbol to a standstill after the target symbol passes over the effective prize-winning line.

When the judgment is made that the backward rotation should be performed, the reel 32C is controlled to stop rotating in the first direction D1 to bring the symbol to a standstill on the winning line after the symbol is shifted in the first direction D1 to the columns corresponding to the number of the shifting symbols. In FIG. 18(*a*), the controlling time duration T1 is variable in accordance with the number of shifting symbols. The sum of the controlling time duration T1 and the over-run and stop operating time duration T2 is indicative of the predetermined time duration for shifting the symbols, e.g., 190 msec. When a predetermined time, e.g., one to several seconds, included in the over-run and stop operating time duration T2 has been passed after stopping the forward rotation of the reel 32C, the reel 32C is controlled to slowly backwardly rotate, i.e., rotate in the second direction D2 to shift the target symbol back to one column thereby causing the target symbol to position on the effective prize-winning line.

It will be understood from the aforementioned description that the game machine according to the present invention has an advantage over the prior art in that the game machine can attract to the player because that the target symbol for winning combination is returned from over-running position to the effective prize-winning line to win the present game, after the player considers that the player fails in the winning in the present game. Accordingly, the player can maintain a high expectation of winning until all reels are completely stopped rotating. The game machine can therefore greatly excite the player just before the game result is determined.

Furthermore, the player having the enormous skill can enjoy the game because that the reel stopping process can be performed under various conditions determined on the basis of the operations of the player to bring the game to win a big prize in the game machine according to the present invention.

Figure 19:
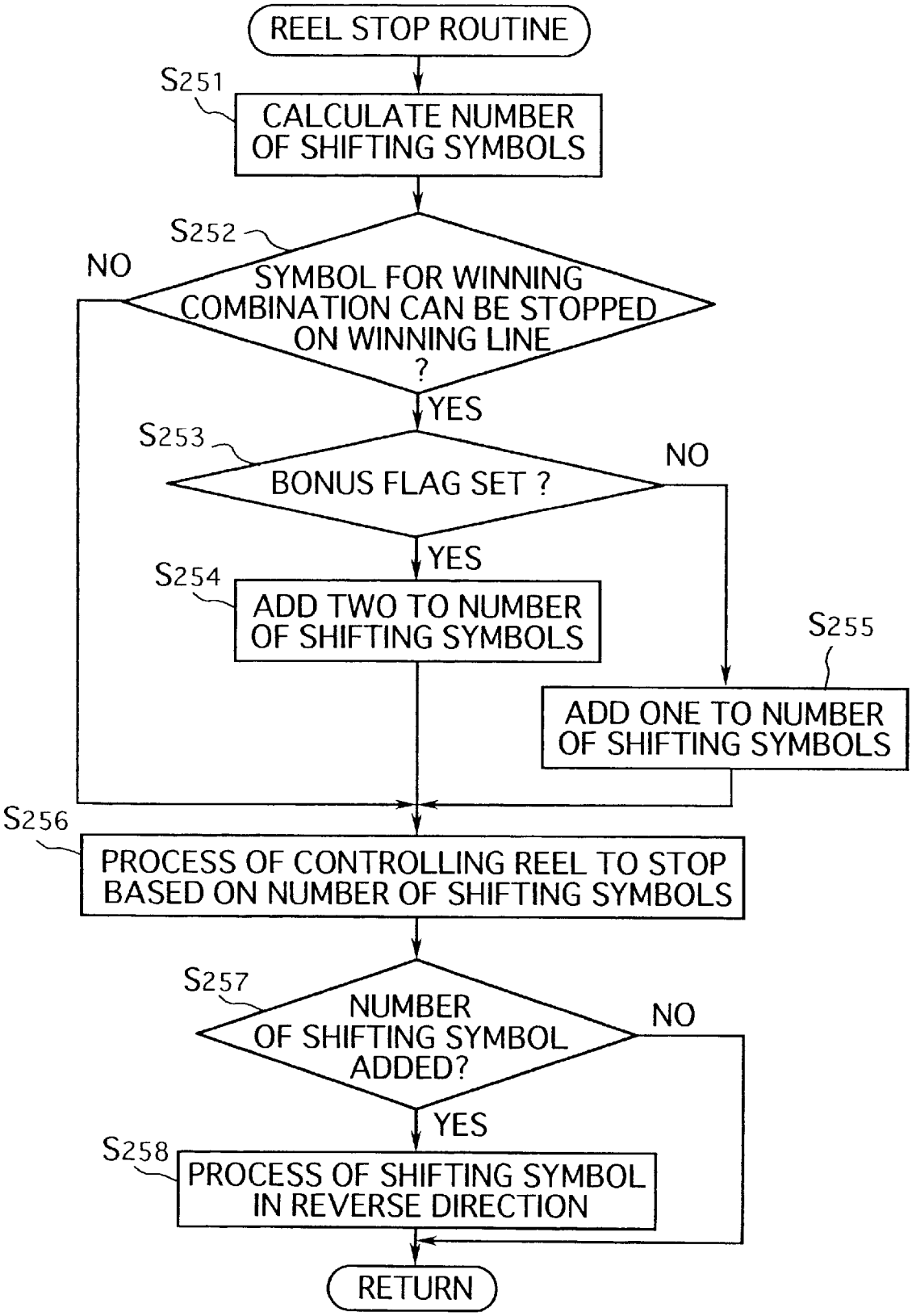
FIG. 19 is a flowchart showing the flow of the reel stopping process routine of a second embodiment of the game machine.

Referring now to FIG. 19 of the drawings, there is shown a second embodiment of the reel stop routine according to the present invention. In the second embodiment, the slot machine may comprise the same constitutional elements as those of the first embodiment except this reel stop routine stored in the ROM 52 and executed by the microcomputer 54.

In the step S251, the microcomputer 54 is operated to calculate the number of shifting symbols. The number of shifting symbols is determined on the basis of the various information including: the flags in the winning request area; the value read out from a predetermined R-register when each stop button is operated; the present positions of the reels (or the positions of the target symbols) and so on. The number of shifting symbols is defmed as the number of symbols which can be shifted to have the target symbol positioned on the effective prize-winning line within a predetermined time duration, e.g., 190 msec, provided for in the present law, after detecting the stop operation for the reel. In case when the symbols are shifted only in the first direction D1, the number of shifting symbols may be limited to four symbols. The R-register is designed to refresh data in the register cyclically varied from 0 to a predetermined value at high speed.

In the following step S252, the microcomputer 54 is operated to judge whether the target symbol for the winning combination can be stopped on the effective prize-winning line or not. This judgment is made on the basis of the flags in the winning request area, i.e., whether any one of the flags including the three "bell" or "bullet" symbols combination flag, and the bonus flags having the RB game flag and the BB game flag, are set or not. When the answer in the step S252 is "YES", the step S252 proceeds to the step S253. When the answer in the step S252 is "NO", the step S252 proceeds to the step S256.

In the step S253, the microcomputer 54 is operated to judge whether the bonus flag is set or not. When the judgment is made that the bonus flag is set, the step S253 proceeds to the step S254 wherein the microcomputer 54 is operated to add a predetermined additional value, e.g., two, to the number of shifting symbols. When, on the other hand, the judgment is made that the bonus flag is reset, the step S253 proceeds to the step S255 wherein the microcomputer 54 is operated to add a predetermined additional value, e.g., one, to the number of shifting symbols. The steps S254 and S255 proceed to the step S256 wherein the microcomputer 54 is operated to perform the reel stopping process wherein the reel is rotated in the first direction D1 to shift the symbol of the reel on the basis of the number of shifting symbols obtained in the step S251, S254 or S255. The reel is thus controlled in the step S256 to shift the target symbol to the position proceeding over the effective prize-winning line to one or two columns ahead.

In the following step S257, the microcomputer 54 is operated to judge whether the addition of the number of shifting symbols is performed in the step S254 or S255 or not. When the answer in the step S257 is "YES", the step S257 proceeds to the step S258. When the answer in the step S257 is "NO", the control is returned to the main routine. In the step S258, the microcomputer 54 is operated to perform the reel stopping process wherein the reel is rotated in the second direction D2 to shift the symbol of the reel on the basis of the predetermined additional value for adding the number of shifting symbols. After rotating the symbols in the first and second directions D1 and D2 in the steps S256 and S258, the symbol of the reel is brought to a standstill on the effective prize-winning line to decide the three-symbols combination.

The slot machine 10 thus constructed can attract to the player because that the target symbol for winning combination is returned from over-running position to the effective prize-winning line to win the present game, after the player considers that the player fails in the winning in the present game. Accordingly, the player can maintain a high expectation of winning until all reels are completely stopped rotating. The slot machine 10 can therefore greatly excite the player just before the game result is determined.

Furthermore, the player having the enormous skill can enjoy the game because that the reel stopping process can be performed under various conditions determined on the basis of the operations of the player to bring the game to win a big prize in the game machine according to the present invention. Particularly, when the present game wins the BB game, the number of shifting symbols is larger than that of the normal game.

Therefore, the player can maintain a higher expectation of winning and be greatly excited.

Figure 20:
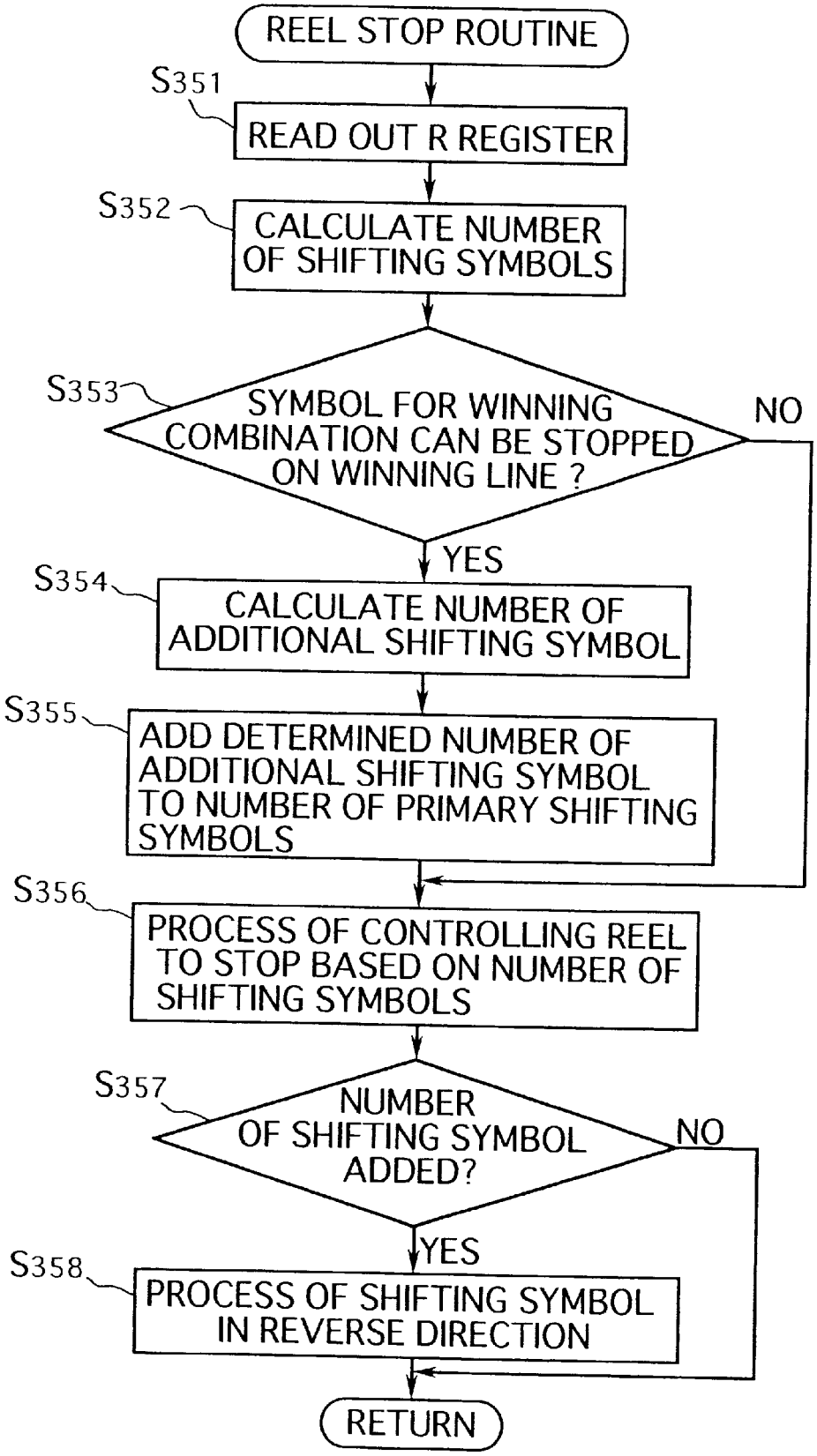
FIG. 20 is a flowchart showing the flow of the reel stopping process routine of a third embodiment of the game machine.

Referring now to FIG. 20 of the drawings, there is shown a third embodiment of the reel stop routine according to the present invention. In the third embodiment, the slot machine may also comprise the same constitutional elements as those of the first embodiment except this reel stop routine stored in the ROM 52 and executed by the microcomputer 54.

In the step S351, the microcomputer 54 is operated to read out the random number from a predetermined R-register. The R-register is designed to refresh data in the register cyclically varied from 0 to 127 at high speed to be able to produce 128 kinds of random numbers. In the step 352, the microcomputer 54 is operated to calculate the number of shifting symbols. The number of shifting symbols is determined on the basis of the various information including: the conditions of the flags in the winning request area; the value read out from the data of the R-register in the step S351 when each stop button is operated; the present positions of the reels (or the positions of the target symbols) and so on.

In the following step S353, the microcomputer 54 is operated to judge whether the target symbol for the winning combination can be stopped on the effective prize-winning line or not. This judgment is made on the basis of the conditions of the flags in the winning request area, i.e., whether any one of the flags including the three "bell" or "bullet" symbols combination flag is set or not, and whether the bonus flags having the RB game flag and the BB game flag are set or not. When the answer in the step S353 is "YES", the step S353 proceeds to the step S354. When the answer in the step S353 is "NO", the step S353 proceeds to the step S356.

In the step S354, the microcomputer 54 is operated to determine the number of additional shifting symbols on the basis of the random number obtained in the step S351. More specifically, the judgment is made by searching a predetermined stop condition table R1 including an R-register value list as shown in FIG. 21. The stop condition table R1 may be indicative of a relationship between the random number ranges and the conditions of the flags in the winning request area, i.e., the previously decided plan of the game result, in order to obtain the number of additional shifting symbols. In this embodiment, the number of additional shifting symbols consists of 0, 1 and 2. For instance, when the three "bell" symbols combination is requested according to the conditions of the flags in the winning request area, the random number extracted from the R-register is grouped into three ranges consisting of 0–50, 51–120 and 121–127. When the random number ranges between 0 and 50, the number of additional shifting symbols is assumed to be 0. When the random number ranges between 51 and 120, the number of additional shifting symbols is assumed to be 1. When the random number ranges between 121 and 127, the number of additional shifting symbols is assumed to be 2.

When, on the other hand, the BB game is requested according to the conditions of the flags in the winning request area, the random number extracted from the R-register is grouped into three ranges consisting of 0–10, 11–40 and 41–127. When the random number ranges between 0 and 10, the number of additional shifting symbols is assumed to be 0. When the random number ranges between 11 and 40, the number of additional shifting symbols is assumed to be 1. When the random number ranges between 41 and 127, the number of additional shifting symbols is assumed to be 2.

The step S354 proceeds to the step S355 wherein the microcomputer 54 is operated to add the number of additional shifting symbols, which is obtained in the step S354, to the number of shifting symbols calculated in the step S352. The step S355 proceeds to the step S356 wherein the microcomputer 54 is operated to perform the reel stopping process wherein the reel is decelerated and rotated in the first direction D1 to shift the symbol of the reel on the basis of the number of shifting symbols obtained in the step S353 or S355 before the reel is completely stop rotating within a predetermined waiting time. The reel is thus controlled in the step S356 to shift the target symbol to the position proceeding over the effective prize-winning line to one or two columns ahead.

In the following step S357, the microcomputer 54 is operated to judge whether the addition of the number of shifting symbols is performed in the step S355 or not. When the answer in the step S357 is "YES", the step S357 proceeds to the step S358. When the answer in the step S357 is "NO", the control is returned to the main routine. In the step S358, the microcomputer 54 is operated to perform the reel stopping process wherein the reel is rotated in the second direction D2 to shift the symbol of the reel on the basis of the number of additional shifting symbols. After rotating the symbols in the first and second directions D1 and D2 in the steps S356 and S358, the symbol of the reel is brought to a standstill on the effective prize-winning line to decide the three-symbols combination.

The slot machine 10 thus constructed can attract to the player because that the target symbol for winning combination is returned from over-running position to the effective prize-winning line to win the present game, after the player considers that the player fails in the winning in the present game. Accordingly, the player can maintain a high expectation of winning until all reels are completely stopped rotating. The slot machine 10 can therefore greatly excite the player just before the game result is determined.

Furthermore, the player having the enormous skill can enjoy the game because that the reel stopping process can be performed under various conditions determined on the basis of the operations of the player to bring the game to win a big prize in the game machine according to the present invention.

In the aforesaid embodiments, the game machine according to the present invention is exemplified in the slot machine. In another embodiment, the game machine according to the present invention may be another game machine including a ball shooting game machine, such as apachinko, or a video game, which has functions of the game machine according to the present invention.

In the above embodiments, the predetermined program may be written by an appropriate programming language. Then a plurality of the program files and data files are converted to an execute format and stored in a nonvolatile storage device, such as PROM (programmable read only memory), EPROM (erasable programmable read only-memory), EEPROM (electrically erasable and programmable ROM), CD-ROM, DVD-ROM and so on. In this embodiment, the ROM 52 may be mounted on a circuit board, not shown, in the control unit 50. The ROM 52 can be removed from the circuit board, thereby making it possible to modify the program and data stored in the ROM 52 with ease. Preferably, the circuit board may be also removed from the control unit 50 to be able to modify and repair the circuit board. Alternatively, the program and data stored in the EPROM may be modified and repaired from the host computer by remote operation.

It will be apparent to those skilled in the art and it is contemplated that variations and/or changes in the embodiments illustrated and described herein may be without departure from the present invention. Accordingly, it is intended that the foregoing description is illustrative only, not limiting, and that the true spirit and scope of the present invention will be determined by the appended claims.

What is claimed is:

1. A game machine for allowing a player to play a game comprising:

displaying means capable of displaying a plurality of predetermined symbol arrangements each having various kinds of symbols arranged in a predetermined order;

scrolling means for allowing said displaying means to display part of said symbols of said respective symbol arrangements on a window having a predetermined winning line crossing over said symbol of said respective symbol arrangements to define said symbols positioned on said winning line as a symbol combination and to scroll said symbols of said symbol arrangements within said window in two different predetermined scroll directions including first and second scroll directions;

scroll starting means for allowing said scrolling means to start to scroll said symbols of said symbol arrangements within said window in said first scroll direction in response to a predetermined start instruction;

receiving means for receiving a plurality of stop instructions corresponding to said plurality of symbol arrangements;

random number generating means for generating a random number;

stop instruction adjusting means for adjusting said plurality of stop instructions received by receiving means, on the basis of the random number generated by said random number generating means;

scroll stopping means for allowing said scrolling means to independently stop scrolling said symbols of said symbol arrangements in response to said plurality of stop instructions, respectively, adjusted by said stop instruction adjusting means to bring the symbol of said corresponding symbol arrangements to a standstill on said winning line to obtain said symbol combination after all of said symbols are stopped scrolling;

shifting means for allowing said displaying means to shift said symbols of said symbol arrangements in said first and second scroll directions within a predetermined waiting time after said stop instructions, respectively, are received by said receiving means to change said symbol combination; and evaluating means for evaluating said symbol combination on the basis of a predetermined winning combination for winning.

2. The game machine as set forth in claim 1, in which said symbols of each of said symbol arrangements are aligned with a line substantially parallel with said first scroll direction, and said first scroll direction is opposite to said second scroll direction.

3. The game machine as set forth in claim 2, wherein said displaying means includes a plurality of rotatable cylindrical reels each provided with said various kinds of symbols arranged on its outer surface at predetermined intervals, and said reels are axially aligned and independently rotatable about an axis in said first and second directions.

4. The game machine as set forth in claim 1, in which said shifting means is operated to judge whether the symbol of each of said symbol arrangements positioned on said winning line is shifted or not on the basis of a predetermined game condition.

5. The game machine as set forth in claim 4, in which said shifting means is operated to determine the number of shifting symbols of each of said symbol arrangements for shifting said symbols in said second scroll direction on the basis of said predetermined game condition.

6. The game machine as set forth in claim 5, in which said shifting means is operated to determine the number of shifting symbols of each of said symbol arrangements for shifting said symbols in said first scroll direction on the basis of said number of symbols of each symbol arrangements for shifting said symbols in said second scroll direction.

7. The game machine as set forth in claim 1, further comprising inputting means for allowing said player to input said stop instructions to said game machine.

8. The game machine as set forth in claim 1, further comprising deciding means for previously deciding a plan of the result of said game, wherein said shifting means being operated to judge whether there is a chance to obtain the result of said game according to said plan decided by said deciding means within said waiting time or not, and to shift said symbol in said first and second scroll directions so that the result of said game accords to said plan decided by said deciding means.

9. The game machine as set forth in claim 8, in which said plan decided by said deciding means includes a plan of said symbol combination for evaluating, and said shifting means is operated to judge whether the symbols of said symbol arrangement can be brought to a standstill on said winning line within said waiting time to obtain said symbol combination according to said plan decided by said deciding means or not, and to shift said symbol in said first and second scroll directions to change said symbol combination in accordance with said plan decided by said deciding means when the judgment is made that the symbols of said symbol arrangement can be brought to a standstill on said winning line within said waiting time to obtain said symbol combination according to said plan decided by said deciding means.

10. A method of controlling a game machine for allowing a player to play a game comprising the steps of:

(a) forming a plurality of predetermined symbol arrangements each having various kinds of symbols arranged in a predetermined order;

(b) displaying part of said symbols of said respective symbol arrangements on a window having a predetermined winning line crossing over said symbol of said respective symbol arrangements to define said symbols positioned on said winning line as a symbol combination;

(c) scrolling said symbols of said symbol arrangements within said window in a first predetermined scroll direction in response to a predetermined start instruction;

(d) receiving a plurality of stop instructions corresponding to said plurality of symbol arrangements;

(e) generating a random number;

(f) adjusting said plurality of stop instructions received in the step (d), on the basis of the random number generated in the step (e):

(g) stopping scrolling said symbols of said symbol arrangements in response to said plurality of said stop instructions, respectively, adjusted in the step (f) to bring the symbols of said corresponding symbol arrangements to a standstill on said winning line;

(h) obtaining said symbol combination after all of said symbol arrangements are stopped scrolling in the step (g);

(i) shifting said symbols of said symbol arrangements in said first scroll direction within a predetermined waiting time after the step (d);

(j) shifting said symbols of said symbol arrangements in a second predetermined scroll direction different from said first scroll direction within said waiting time;

(k) performing the steps (i) and (j) to change said symbol combination; and (l) evaluating said symbol combination on the basis of a predetermined winning combination for winning.

11. The method as set forth in claim 10, in which said symbols of each of said symbol arrangements are aligned with a line substantially parallel with said first scroll direction, and said first scroll direction is opposite to said second scroll direction.

12. The method as set forth in claim 10, in which the step (k) has the step of judging whether the symbol of each of said symbol arrangements positioned on said winning line is shifted or not on the basis of a predetermined game condition.

13. The method as set forth in claim 12, in which the step (j) has the step of determining the number of shifting symbols of each of said symbol arrangements for shifting said symbols in said second scroll direction on the basis of said predetermined game condition.

14. The method as set forth in claim 13, in which the step (i) has the step of determining the number of shifting symbols of each of said symbol arrangements for shifting said symbols in said first scroll direction on the basis of said number of symbols of each symbol arrangements for shifting said symbols in said second scroll direction in the step (j).

15. The method as set forth in claim 10, further comprising the step of allowing said player to input said stop instructions to said game machine.

16. The method as set forth in claim 10, further comprising the steps of:

(m) deciding a plan of the result of said game;

(n) judging whether there is a chance to obtain the result of said game according to said plan decided in the step (m) within said waiting time or not; and (o) performing the step (k) so that the result of said game accords to said plan decided in the step (m).

17. The method as set forth in claim 16, in which said plan decided in the step (m) includes a plan of said symbol combination for evaluating, the step (n) having the step of judging whether the symbols of said symbol arrangement can be brought to a standstill on said winning line within said waiting time to obtain said symbol combination according to said plan decided in the step (m) or not, and the step (k) having the step of performing the step (j) to change said symbol combination in accordance with said plan decided in the step (m) when the judgment is made in the step (n) that the symbols of said symbol arrangement can be brought to a standstill on said winning line within said waiting time to obtain said symbol combination according to said plan decided in the step (m).

18. A game machine for allowing a player to play a game comprising:

displaying means capable of displaying a predetermined symbol arrangement having various kinds of symbols arranged in a predetermined order;

scrolling means for allowing said displaying means to display part of said symbols of said symbol arrangement on a window having a predetermined winning point and to scroll said symbols within said window in a first predetermined scroll direction;

scroll starting means for allowing said scrolling means to start to scroll said symbols within said window in said first scroll direction in response to a predetermined start instruction;

receiving means for receiving a predetermined stop instruction;

random number generating means for generating a random number;

stop instruction adjusting means for adjusting said stop instruction, received by receiving means, on the basis of the random number generated by said random number generating means;

scroll stopping means for allowing said scrolling means to stop scrolling said symbols in response to said stop instruction adjusted by said stop instruction adjusting means to bring one of said symbols to a standstill at said winning point;

shifting means for allowing said displaying means to shift said symbols in said first scroll direction and a second predetermined scroll direction different from said first scroll direction within a predetermined waiting time after said stop instruction is received by said receiving means to change the kind of the symbol positioned at said winning point; and evaluating means for evaluating the kind of the symbol positioned at said winning point on the basis of a predetermined kind of symbol for winning.

19. The game machine as set forth in claim 18, in which said symbols are aligned with a line substantially parallel with said first scroll direction, and said first scroll direction is opposite to said second scroll direction.

20. The game machine as set forth in claim 18, in which said shifting means is operated to judge whether the symbol positioned at said winning point is shifted or not on the basis of a predetermined game condition.

21. The game machine as set forth in claim 20, in which said shifting means is operated to determine the number of shifting symbols for shifting said symbols in said second scroll direction on the basis of said predetermined game condition.

22. The game machine as set forth in claim 21, in which said shifting means is operated to determine the number of shifting symbols for shifting said symbols in said first scroll direction on the basis of said number of shifting symbols for shifting said symbols in said second scroll direction.

23. The game machine as set forth in claim 18, further comprising inputting means for allowing said player to input said stop instruction to said game machine.

24. The game machine as set forth in claim 18, further comprising deciding means for previously deciding a plan of the result of said game, wherein said shifting means being operated to judge whether there is a chance to obtain the result of said game according to said plan decided by said deciding means within said waiting time or not, and to shift said symbol in said first and second scroll directions so that the result of said game accords to said plan decided by said deciding means.

25. The game machine as set forth in claim 24, in which said plan decided by said deciding means includes a plan of said kind of symbol for evaluating, and said shifting means is operated to judge whether the symbol of said symbol arrangement can be brought to a standstill at said winning point within said waiting time to obtain said symbol according to said plan decided by said deciding means or not, and to shift said symbol in said second scroll direction to change the kind of said symbol in accordance with said plan decided by said deciding means when the judgment is made that the symbol of said symbol arrangement can be brought to a standstill at said winning point within said waiting time to obtain said symbol according to said plan decided by said deciding means.

26. A method of controlling a game machine for allowing a player to play a game, comprising the steps of:

(a) forming a predetermined symbol arrangement having various kinds of symbols arranged in a predetermined order;

(b) displaying part of said symbols of said symbol arrangement on a window;

(c) scrolling said symbols within said window in a first predetermined scroll direction in response to a predetermined start instruction;

(d) receiving a predetermined stop instruction;

(e) generating a random number;

(f) adjusting said stop instruction received in the step (d), on the basis of the random number generated in the step (e);

(g) stopping the scroll of said symbols in response to said stop instruction adjusted in the step (f) to bring one of said symbols to a standstill at a predetermined winning point provided with said window;

(h) shifting said symbol in said first scroll direction within a predetermined waiting time after the step (d);

(i) shifting said symbol in a second predetermined scroll direction different from said first scroll direction;

(j) performing the steps (h) and (i) to change the kind of the symbol positioned at said winning point; and (k) evaluating the kind of the symbol positioned at said winning point on the basis of a predetermined kind of symbol for winning.

27. The method as set forth in claim 26, in which said symbols are aligned with a line substantially parallel with said first scroll direction, and said second scroll direction is opposite to said first scroll direction.

28. The method as set forth in claim 26, in which the step (j) has the step of judging whether said symbol positioned at said winning point is shifted or not on the basis of a predetermined game condition.

29. The method as set forth in claim 28, in which the step (i) has the step of determining the number of shifting symbols for shifting said symbols in said second scroll direction on the basis of said predetermined game condition.

30. The method as set forth in claim 29, in which the step (h) has the step of determining the number of shifting symbols for shifting said symbols in said first scroll direction on the basis of said number of shifting symbols for shifting said symbols in said second scroll direction in the step (i).

31. The method as set forth in claim 26, further comprising the step of allowing said player to input said stop instruction to said game machine.

32. The method as set forth in claim 26, further comprising the steps of:

(l) deciding a plan of the result of said game; and (m) judging whether there is a chance to obtain the result of said game according to said plan decided in the step (l) within said waiting time or not; and (n) performing the step (k) so that the result of said game accords to said plan decided in the step (l).

33. The method as set forth in claim 32, in which said plan decided in the step (l) includes a plan of said kind of symbol for evaluating, the step (m) has the step of judging whether the symbol of said symbol arrangement can be brought to a standstill at said winning point within said waiting time to obtain said symbol according to said plan decided in the step (l) or not, and the step (j) having the step of performing the step (i) to change the kind of said symbol in accordance with said plan decided in the step (l) when the judgment is made in the step (m) that the symbol of said symbol arrangement can be brought to a standstill at said winning point within said waiting time to obtain said symbol according to said plan decided in the step (l).

* * * * *